US009230557B2

(12) United States Patent
Nagel et al.

(10) Patent No.: US 9,230,557 B2
(45) Date of Patent: Jan. 5, 2016

(54) APPARATUS, METHOD AND COMPUTER PROGRAM FOR MANIPULATING AN AUDIO SIGNAL COMPRISING A TRANSIENT EVENT

(75) Inventors: Frederik Nagel, Nuremberg (DE); Andreas Walther, Crissler (CH); Guillaume Fuchs, Erlangen (DE); Jeremie Lecomte, Fürth (DE); Harald Popp, Tuchenbach (DE); Tilo Wik, Esslingen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 823 days.

(21) Appl. No.: 13/191,780

(22) Filed: Jul. 27, 2011

(65) Prior Publication Data

US 2012/0051549 A1 Mar. 1, 2012

Related U.S. Application Data

(63) Continuation of application No. PCT/EP2010/050042, filed on Jan. 5, 2010.

(60) Provisional application No. 61/148,759, filed on Jan. 30, 2009, provisional application No. 61/231,563, filed on Aug. 5, 2009.

(30) Foreign Application Priority Data

Sep. 30, 2009 (EP) ..... 09012410

(51) Int. Cl.
*H04R 29/00* (2006.01)
*G10L 21/04* (2013.01)

(Continued)

(52) U.S. Cl.
CPC ..... *G10L 21/04* (2013.01); *G10L 19/025* (2013.01); *G10L 19/028* (2013.01)

(58) Field of Classification Search
CPC ..... G10L 19/025; G10L 19/028
USPC ..... 381/56
See application file for complete search history.

(56) References Cited

U.S. PATENT DOCUMENTS 5,933,801 A 8/1999 Fink et al.
6,262,943 B1 7/2001 Clarke (Continued)

FOREIGN PATENT DOCUMENTS

EP 1918911 5/2008
TW I239157 B 9/2005

(Continued)

OTHER PUBLICATIONS

Bello, Juan P. et al., "A Tutorial on Onset Detection in Music Signals", IEEE Transactions on Speech and Audio Processing;, Sep. 2005, pp. 1-13.

(Continued)

*Primary Examiner* — Joseph Saunders, Jr.
(74) *Attorney, Agent, or Firm* — Michael A. Glenn; Perkins Coie LLP

(57) ABSTRACT

An apparatus for manipulating an audio signal comprising a transient event has a transient signal replacer configured to replace a transient signal portion, comprising the transient event of the audio signal, with a replacement signal portion adapted to signal energy characteristics of one or more transient signal portions of the audio signal, or to signal energy characteristics of the transient signal portion, to obtain a transient-reduced audio signal. The apparatus also has a signal processor configured to process the transient-reduced audio signal to obtain a processed version of the transient-reduced audio signal. The apparatus also has a transient-signal-re-inserter configured to combine the processed version of the transient-reduced audio signal with a transient signal representing, in an original or processed form, a transient content of the transient signal portion.

20 Claims, 17 Drawing Sheets

(51) Int. Cl.
*G10L 19/025* (2013.01)
*G10L 19/028* (2013.01)

(56) References Cited

U.S. PATENT DOCUMENTS

| | | | | |
|---|---|---|---|---|
| 6,549,884 | B1 | 4/2003 | Laroche et al. | |
| 6,680,972 | B1 | 1/2004 | Liljeryd et al. | |
| 7,103,088 | B2 | 9/2006 | Misra et al. | |
| 2003/0033140 | A1 | 2/2003 | Taori et al. | |
| 2003/0083886 | A1* | 5/2003 | Den Brinker et al. | 704/500 |
| 2003/0156624 | A1 | 8/2003 | Koslar | |
| 2004/0122662 | A1 | 6/2004 | Crockett | |
| 2004/0133423 | A1* | 7/2004 | Crockett | 704/229 |
| 2004/0172239 | A1 | 9/2004 | Kolesnik et al. | |
| 2005/0204904 | A1 | 9/2005 | Lengeling et al. | |
| 2006/0018486 | A1* | 1/2006 | Neoran et al. | 381/63 |
| 2007/0009013 | A1 | 1/2007 | Misra et al. | |
| 2007/0078650 | A1 | 4/2007 | Rogers | |
| 2007/0242833 | A1* | 10/2007 | Herre et al. | 381/61 |
| 2008/0052079 | A1 | 2/2008 | Ohguri et al. | |
| 2012/0195434 | A1 | 8/2012 | Herre et al. | |

FOREIGN PATENT DOCUMENTS

| | | | |
|---|---|---|---|
| WO | WO 97/09712 | A2 | 3/1997 |
| WO | WO-2007/118533 | | 10/2007 |
| WO | WO 2009/112141 | | 9/2009 |

OTHER PUBLICATIONS

Brossier, Paul et al., "Real-Time Temporal Segmentaion of Note Objects in Music Signals", Center for Digital Music, Queen Mary Univ. of London,UK; presented at ICMC 2004, Nov. 2004, 4 pages.

Daudet, Laurent , "A Review on Techniques for the Extraction of Transients in Musical Signals", Laboratoire d'Acoustique Musicale; University of Paris; France;, Sep. 2005, 15 pages.

Dolson, Mark , "The Phase Vocoder: A Tutorial", The MIT Press; Computer Music Journal, vol. 10., No. 4; Winter 1986, 14-27.

Dutilleux, P. et al., "Time-Segment Processing", DAFX: Digital Audio Effects; Germany, ISBN: 0-471-49078-4, Sep. 2002, 202-297.

Duxbury, Chris et al., "A Hybrid Approach to Musical Note Onset Detection", Proc. of the 5th Int. Conference on Digital Audio Effects, Hamburg, Germany; Sep. 26-28, 2002, 33-38.

Duxbury, Chris et al., "Improved Time-Scaling of Musical Audio Using Phase Locking at Transients", Audio Engineering Society Convention Paper 5530; Presented at the 112th Convention ; Munich, Germany, May 10-13, 2002, pp. 1-5.

Duxbury, Chris et al., "Separation of Transient Information in Musical Audio Using Multiresolution Analysis Techniques", Proceedings of the COST G-6 Conference on Digital Audio Effects, Limerick, Ireland, Dec. 6-8, 2001., DAFX 1-4.

Edler, Von Bernd , "Coding of Audio Signals with Overlapping Block Transform and Adaptive Window Function", Schiele & Schon; ISSN 0016-1136; University of Hannover, Sep. 9, 1989, pp. 252-256.

Flanagan, J L. et al., "Phase Vocoder", The Bell System Technical Journal; Nov. 1966, 1493-1509.

Goodwin, Michael et al., "Enhancement of Audio Signals Using Transient Detection and Modification", Presented at the AES 117th Convention, San Francisco, CA;, Oct. 28-31, 2004, 11 pages.

Goodwin, Michael M. et al., "Frequency-Domain Algorithms for Audio Signal Enhancement Based on Transient Modification", Creative Advanced Technology Center, J. Audio Eng. Soc.; Scotts Valley, CA; vol. 54, No. 9;, Sep. 2006, 827-840.

Karrer, Thorsten et al., "PhaVORIT: A Phase Vocoder for Real-Time Interactive Time-Stretching", Media Computing Group; RWTH Aachen Univ.; Aachen, Germany; and In Proc. of the ICMC Int'l Computer Music Conference, Nov. 2006, 8 pages.

Klapuri, Anssi , "Sound Onset Detection by Applying Psychoacousitc Knowledge", Signal Processing Laboratory, Tampere University of Technology, Tampere, Finland, ICASSP '99, Mar. 1999, 4 pages.

Laroche, Jean et al., "Improved Phase Vocoder Time-Scale Modification of Audio", IEEE Transactions on Speech and Audio Processing. vol. 7, No. 3,, May 1999, 323-332.

Laroche, Jean et al., "New Phase-Vocoder Techniques for Pitch-Shifting, Harmonizing and Other Exotic Effects", Proc. 1999 IEEE Workshop on Applications of Signal Processing to Audio and Acoustics, New Paltz, New York;, Oct. 17-20, 1999, 91-94.

Lee, Wan-Chi et al., "Musical Onset Detection Based on Adaptive Linear Prediction", Integrated Media Systems Center and Department of Electrical Engineering, Univ. of Southern California, Los Angeles, CA; presented at ICME 2006, Jul. 2006, 957-960.

Levine, Scott N. , "A Sines+Transients+Noise Audio Representation for Data Compression and Time/Pitch Scale Modifications", Center for Computer Research in Music and Acoustics; Dept. of Music Stanford Univ., Stanford, CA, Sep. 1998, pp. 1-21.

Maher, Robert C. , "A Method for Extrapolation of Missing Digital Audio Data", JAES, vol. 42, No. 5,, May 1994, pp. 350-357.

Masri, Paul et al., "Improved Modelling of Attack Transients in Music Analysis-Resynthesis", Digital Music Research Group, University of Bristol, Bristol U.K.; ICMC 1996, Hong Kong, Aug. 1996, 4 pages.

Nagel, Frederik et al., "A Phase Vocoder Driven Bandwidth Extension Method with Novel Transient Handling for Audio Codecs", Audio Engineering Society Convention Paper, Presented at the 126th Convention, Munich, Germany, May 7-10, 2009, pp. 1-8.

Niemeyer, Oliver et al., "Detection and Extraction of Transients for Audio Coding", Presented at the AES 120th Convention, Paris, France, May 20-23, 2006, pp. 1-8.

Puckette, Miller , "Phase-Locked Vocoder", 1995 IEEE Reprinted from Proceedings, 1995 IEEE ASSP Conference on Applications of Signal Processing to Audio and Acoustics; Mohonk, NY; Oct. 1995, 4 pages.

Quatieri, ,"Time-Scale Modification of Complex Acoustic Signals in Noise", Massachusetts Institute of Technology Lincoln Laboratory, Lincoln, Massachusetts,, Feb. 4, 1994, 63 pages.

Ravelli, Emmanuel et al., "Fast Implementation for Non-Linear Time-Scaling of Stereo Signals", Proc. of the 8th Int. Conference on Digital Audio Effects, Madrid, Spain,, Sep. 20-22, 2005, pp. DAFX 1-4.

Robel, Axel , "A New Approach to Transient Processing in the Phase Vocoder", Proc. of the 6th Int. Conference on Digital Audio Effects, London, UK, Sep. 8-11, 2003, pp. DAFX 1-6.

Robel, Axel , "Transient Detection and Preservation in the Phase Vocoder", ICMC '03, Singapore, 2003, pp. 247-250.

Verma, Tony S. , "Time Scale Modification Using a Sines+Transients+Noise Signal Model", in DAFX98, Barcelona, Spain, Nov. 1998, 4 pages.

Walther, Andreas et al., "Using Transient Suppression in Blind Multi-Channel Upmix Algorithms", Audio Engineering Society, Convention Paper 699; Presented at the 122nd Convention; Vienna, Austria, May 5-8, 2007, pp. 1-10.

Han, Byeong-Jun et al: "An Efficient Voice Transcription Scheme for Music Retrieval"; Korea; Apr. 2007; pp. 366-371; IEEE; XP031086556.

Kumar M S: "Low delay nearend speech detector for acoustic echo cancellation"; Nov. 19, 2008; IEEE, Piscataway New Jersey; pp. 1-6; XP031414118.

Hamdy, K N et al: "Time-scale modification of audio signals with combined harmonic and wavelet representations"; Apr. 1997; Los Alamitos, CA; pp. 439-442; XP010226229.

Khaled, , "Time-Scale Modification of Audio Signals with Combined Harmonic and Wavelet Representations", 1997; IEEEE; University of Minnesota, MN; Stanford University, Palo Alto, CA; Sony Corporation, Kanagawa, Japan, 1-5.

* cited by examiner (filterbank implementation)

(transform implementation)

APPARATUS, METHOD AND COMPUTER PROGRAM FOR MANIPULATING AN AUDIO SIGNAL COMPRISING A TRANSIENT EVENT

CROSS-REFERENCE TO RELATED APPLICATIONS

This application is a continuation of copending International Application No. PCT/EP2010/050042, filed Jan. 5, 2010, which is incorporated herein by reference in its entirety, and additionally claims priority from U.S. Patent Application No. 61/148,759, filed Jan. 30, 2009, U.S. Patent Application No. 61/231,563, filed Aug. 5, 2009 and European Patent Application No. 09012410.8, filed Sep. 30, 2009, which are all incorporated herein by reference in their entirety.

BACKGROUND OF THE INVENTION

Embodiments according to the invention relate to an apparatus, a method and a computer program for manipulating an audio signal comprising a transient event.

In the following, typical application scenarios will be described, in which embodiments according to the invention may be applied.

In current audio signal processing systems, audio signals are often processed using digital techniques. Specific signal portions such as transients, for example, place special requirements upon digital signal processing.

Transient events (or "transients") are events in a signal during which the energy of the signal in the whole band or in a certain frequency range is rapidly changing, i.e., its energy is rapidly increasing or rapidly decreasing. Characteristic features of specific transients (transient events) can be found in the distribution of signal energy in the spectrum. Typically, the energy of the audio signal during a transient event is distributed over the whole frequency range, while in non-transient signal portions the energy is normally concentrated in a low frequency portion of the audio signal or in one or more specific bands. This means that a non-transient signal portion, which is also called a stationary or "tonal" signal portion, has a spectrum, which is non-flat. Also, the spectrum of the transient signal portion is typically chaotic and "non-predictable" (for example when knowing a spectrum of a signal portion preceding the transient signal portion). In other words, the energy of the signal is included in a comparatively small number of spectral lines or spectral bands, which are strongly emphasized over a noise floor of an audio signal. In a transient portion however, the energy of the audio signal will be distributed over many different frequency bands and, specifically, will be distributed in a high frequency portion so that a spectrum for the transient portion of the audio signal will be comparatively flat and will typically be flatter than a spectrum of a tonal portion of the audio signal. Nevertheless, it should be noted that there are other types of signals having a flat spectrum, like, for example, noise-like signals, which signals do not represent a transient. However, while spectral bins of noise-like signals have uncorrelated or weakly correlated phase values, there is often a very significant phase correlation of spectral bins in the presence of a transient.

Typically, a transient event is a strong change in a time domain representation of the audio signal, which means that the signal will include many higher frequency components when a Fourier decomposition is performed. An important feature of these many higher harmonics is that the phases of these higher harmonics are in a very specific mutual relationship, so that the superposition of all the harmonics will result in a rapid change of signal energy (when considered in the time domain). In other words, there exists a strong correlation across the spectrum in the proximity of a transient event. The specific phase situation among all harmonics can also be termed as a "vertical coherence". This "vertical coherence" is related to a time/frequency spectrogram representation of the signal where a horizontal direction corresponds to an evolution of the signal over time and where a vertical dimension describes the dependency over the frequency of the spectral components in a short-time spectrum over frequency.

If, for example, changes are performed over large time domains, e.g. by quantization, said changes will influence the entire block. Since transients are characterized by a short-term increase in energy, this energy will probably be smeared, when the block is changed, across the entire region represented by the block.

The problem becomes particularly evident also when the reproduction speed of a signal is changed while the pitch is maintained or when the signal is transposed while the original duration of the reproduction is maintained. Both may be accomplished using a phase vocoder or a method such as (P)SOLA (refer to references [A1] to [A4] regarding this issue). The latter is achieved by reproducing the stretched signal, accelerated by the factor of the time stretching. With time-discrete signal representation, this corresponds to downsampling the signal by the stretch factor while maintaining the sampling frequency. Methods of time stretching such as the phase vocoder are actually suited only for stationary or quasi-stationary signals, since transients are "smeared" in time by dispersion. The phase vocoder impairs the so-called vertical coherence properties (related to a time/frequency spectrogram representation) of the signal.

Time stretching of audio signals plays an important role in both, entertainment and arts. Common algorithms are based on overlap and add (OLA) techniques, such as the Phase Vocoder (PV), Synchronous Overlap Add (SOLA), Pitch Synchronous Overlap Add (PSOLA), and Waveform Similarity Overlap Add (WSOLA). While these algorithms are capable of changing the replay speed of audio signals while preserving their original pitch, transients are not well preserved. Time stretching of an audio signal without altering its pitch using OLA needs the separate processing of the transients and the sustained signal portions in order to avoid transient dispersion [B1] and time domain aliasing which often occurs with WSOLA and SOLA. A challenge is issued by the task to stretch a combination of a very tonal signal such as a pitch pipe and a percussive signal such as castanets.

In the following, reference will be made to some conventional approaches in order to provide the background of the present invention.

Some current methods stretch the time around the transients more intensely so as to have to perform no or only little time stretching over the duration of the transient (see, for example, references [5] to [8]).

The following articles and patents describe methods of time and/or pitch manipulation: [A1], [A2], [A3], [A4], [A5], [A6], [A7], [A8].

In [B2] a method is proposed that approximately preserves the envelope of a signal in the time stretched version as well as its spectral characteristics. This approach expects a time dilated percussive event to decay slower than the original.

Several widely known methods allow for a distinguished processing of transients and stationary signal components, for instance, the modelling of a signal as summation of sines, transients, and noise (S+T+N) [B4, B5]. In order to preserve transients after time scale modification, all three parts are stretched separately. This technique is capable of perfectly preserving transient components of audio signals. The resulting sound is, however, often perceived as unnatural.

Further approaches vary the amount of time stretching and set it to one during the transient time or lock the phase on the transient event [B3, B6, B7].

The paper [B8] demonstrates how transients can be preserved in time and frequency stretching with the PV. In that approach, transients were cut out from the signal before it was stretched. The removal of the transient parts resulted in gaps within the signal which were stretched by the PV process. After the stretching, the transients were re-added to the signal with a surrounding that fitted the stretched gaps.

In view of the above, there is a need for a concept of manipulating an audio signal comprising a transient event which provides for an output signal of improved perceived quality.

SUMMARY

According to an embodiment, an apparatus for manipulating an audio signal having a transient event may have a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal; a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion; wherein the transient signal replacer is configured to extrapolate amplitude values of one or more signal portions preceding the transient signal portion, to acquire amplitude values of the replacement signal portion, and wherein the transient signal replacer is configured to extrapolate phase values of one or more signal portions preceding the transient signal portion to acquire phase values of the replacement signal portion.

According to another embodiment, an apparatus for manipulating an audio signal having a transient event may have a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal; a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion; wherein the transient signal replacer is configured to interpolate between an amplitude value of a signal portion preceding the transient signal portion and an amplitude value of a signal portion following the transient signal portion, to acquire one or more amplitude values of the replacement signal portion, and wherein the transient signal replacer is configured to interpolate between a phase value of a signal portion preceding the transient signal portion and a phase value of a signal portion following the transient signal portion, to acquire one or more phase values of the replacement signal portion.

According to another embodiment, an apparatus for manipulating an audio signal having a transient event may have a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal; a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion; wherein the transient signal replacer is configured to extrapolate, in a time-frequency domain, complex-valued time-frequency-domain coefficients associated with a non-transient signal portion of the audio signal preceding the transient signal portion, to acquire time-frequency domain coefficients of the replacement signal portion, or wherein the transient signal replacer is configured to interpolate, in a time-frequency domain, between complex-valued time-frequency-domain coefficients associated with a non-transient signal portion of the audio signal preceding the transient signal portion, and complex-valued time-frequency domain coefficients associated with a non-transient signal portion of the audio signal following the transient signal portion, to acquire time-frequency domain coefficients of the replacement signal portion.

According to another embodiment, a method for manipulating an audio signal having a transient event may have the steps of replacing a transient signal portion, comprising the transient event, of the audio signal with a replacement signal portion adapted to signal energy characteristics of one or more non-transient signal portions of the audio signal, or to signal energy characteristics of the transient signal portion, to acquire a transient-reduced audio signal; processing the transient-reduced audio signal, to acquire a processed version of the transient-reduced audio signal; and combining the processed version of the transient-reduced audio signal with a transient signal representing, in an original or processed form, a transient content of the transient signal portion; wherein amplitude values of one or more signal portions preceding the transient signal portion are extrapolated to acquire amplitude values of the replacement signal portion, and wherein phase values of one or more signal portions preceding the transient signal portion are extrapolated to acquire phase values of the replacement signal portion; or wherein an interpolation is performed between an amplitude value of a signal portion preceding the transient signal portion and an amplitude value of a signal portion following the transient signal portion, to acquire one or more amplitude values of the replacement signal portion, and wherein an interpolation is performed between a phase value of a signal portion preceding the transient signal portion and a phase value of a signal portion following one or more phase values of the replacement signal portion; or wherein complex-valued time-frequency-domain coefficients associated with a non-transient signal portion of the audio signal preceding the transient signal portion are extrapolated in a time-frequency-domain, to acquire time-frequency-domain coefficients of the replacement signal portion; or wherein an interpolation is performed, in a time-frequency-domain, between complex-valued time-frequency-domain coefficients associated with a non-transient signal portion of the audio signal preceding the transient signal portion, and complex-valued time-frequency-domain coefficients associated with a non-transient signal portion of the audio signal following the transient signal portion, to acquire time-frequency-domain coefficients of the replacement signal portion.

According to another embodiment, a computer program may perform the above-mentioned method, when the computer program runs on a computer.

An embodiment according to the invention creates an apparatus for manipulating an audio signal comprising a transient event. The apparatus comprises a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to obtain a transient-reduced audio signal. The apparatus further comprises a signal processor configured to process the transient-reduced audio signal, to obtain a processed version of the transient-reduced audio signal. The apparatus also comprises a transient signal re-inserter configured to combine the processed version of the transient-reduced audio signal with a transient signal representing, in an original or processed form, a transient content of the transient signal portion.

The above described embodiment is based on the finding that the signal processor provides an output signal of improved quality if the transient signal portion is replaced by a replacement signal portion, a signal energy of which is adapted to signal energy characteristics of the original audio signal, while reducing or eliminating the transient event. This concept avoids large step-wise changes of the energy of the signal input to the signal processor, which would be caused by simply eliminating the transient signal portion from the audio signal, and also avoids, or at least reduces, the detrimental effect of a transient on the signal processor.

Thus, by removing or reducing the transient event in the audio signal (to obtain the transient reduced audio signal), and by limiting a change of the energy of the transient-reduced audio signal when compared to the input audio signal, the signal processor receives an appropriate input signal, such that its output signal approximates a desired output signal in the absence of a transient event.

In an embodiment, the transient signal replacer is configured to provide the replacement signal portion (or transient-reduced signal portion) such that the replacement signal portion represents a time signal having a smoothed temporal evolution when compared to the transient signal portion, and such that a deviation between an energy of the replacement signal portion and an energy of a non-transient signal portion of the audio signal preceding the transient signal portion or following the transient signal portion is smaller than a predetermined threshold value. In this way, it can be achieved that the replacement signal portion fulfills two conditions, namely a so-called "transient condition" and a so-called "energy condition". The transient condition indicates that a transient event, which is represented by a step or peak in a time domain, is limited in intensity (or step height, or peak height) within the replacement signal portion. The energy condition further indicates that the transient-reduced audio signal (of the replacement signal portion) should have a smooth temporal evolution of the spectral energy distribution. Discontinuities in the temporal evolution of the spectral energy distribution typically results in the generation of audible artifacts. Accordingly, by limiting such temporal discontinuities of the spectral energy distribution, audible artifacts can be avoided, which could result from a mere deletion (without replacement) of a transient signal portion from the input audio signal.

In an embodiment, the transient signal replacer is configured to extrapolate amplitude values of one or more signal portions preceding the transient signal portion, to obtain amplitude values of the replacement signal portion. The transient signal replacer is also configured to extrapolate phase values of one or more signal portions preceding the transient signal portion to obtain phase values of the replacement signal portion. Using this approach, a smooth amplitude evolution of the transient-reduced audio signal can be obtained. Further, the phases of the different spectral components of the transient-reduced audio signal are well controlled (by means of extrapolation), such that the transient event, which is characterized by specific phase values during the transient signal portion (different from phase values of non-transient signal portions), is suppressed.

In other words, phase values are enforced by means of extrapolation which are generated differently from phase values characterizing the transient. Extrapolation also provides the advantage that the knowledge of the audio signal portions preceding the transient signal portion is sufficient in order to perform the extrapolation. However, it is naturally possible to further apply some side information, for example extrapolation parameters, to perform the extrapolation.

In another embodiment, the transient signal re-inserter (150) is configured to cross-fade the processed version of the transient-reduced audio signal with the transient signal representing, in an original or processed form, a transient content of the transient signal portion. In this case, the processed version of the transient-reduced signal may be a time-stretched version of the input audio signal. Accordingly, the transient may be smoothly reinserted into a stretched version of the input audio signal. In other words, after the (time-) stretching of the transient-reduced audio signal, the transients (in processed or unprocessed form) are re-added to the signal with a surrounding that fitted the stretched gaps.

In another embodiment, the transient signal replacer is configured to interpolate between an amplitude value of a signal portion preceding the transient signal portion and an amplitude value of a signal portion following the transient signal portion to obtain one or more amplitude values of the replacement signal portion. The transient signal replacer is, in addition, configured to interpolate between a phase value of a signal portion preceding the transient signal portion and a phase value of a signal portion following the transient signal portion to obtain one or more phase values of the replacement signal portion. By performing an interpolation, a particularly smooth temporal evolution of both amplitude and phase values can be obtained. The interpolation of the phase also typically results in a reduction or cancelation of the transient event, as transients typically comprise a very specific phase distribution in the direct proximity of the transient, which phase distribution is typically different from the phase distribution at a certain spacing away from the transient.

In an embodiment, the transient signal replacer is configured to apply a weighted noise (e.g. a spectrum of a noise-like signal, adapted to the signal energy characteristics of one or more non-transient signal portions of the audio signal, or to a signal energy characteristic of the transient signal portion) to obtain, the amplitude values of the replacement signal portion, and to apply a weighted noise to obtain the phase values of the replacement signal portion. It is possible, by applying a weighted noise, to further reduce the transient while keeping the impact on the energy sufficiently small.

In an embodiment, the transient signal replacer is configured to combine non-transient components of the transient signal portion with the extrapolated or interpolated values to obtain the replacement signal portion. It has been found that an improved quality of the transient-reduced audio signal (and of the processed version thereof, which is obtained using the signal processor) can be achieved, if non-transient components of the transient signal portion are maintained. For example, tonal components of the transient signal portion may only have a limited impact on the transient (because a temporal transient is typically caused by a broadband signal having a specific phase distribution over frequency). Thus, the tonal non-transient components of the transient signal portion may carry a precious information which can actually contribute to a desirable output signal of the signal processor. Thus, by keeping such signal portions—while reducing the transient—can contribute to an improvement of the processed audio signal.

In an embodiment of the invention, the transient signal replacer is configured to obtain replacement signal portions of variable length in dependence of a length of a transient signal portion. It has been found that the audio signal quality can sometimes be improved by adapting the length of the replacement signal portions to a variable length of the transient signal portions. For example, in some signals the transient signal portions may by of a very short duration. In this case, an optimized processed audio signal can be obtained by replacing only a relatively short portion of the input audio signal. Thus, as much (non-transient) information as possible of the original input audio signal can be maintained. By also keeping the replacement signal portions short (in accordance with the length of the transient signal portion), an overlap of subsequent replacement signal portions can, in many situations, be avoided. Therefore, in most cases it can be accomplished that there is an original non-transient signal portion between two subsequent replacement signal portions. Hence, the processed audio signal is generated with sufficient precision, keeping as much (non-transient) information of the original input audio signal as possible.

In an embodiment, the signal processor is configured to process the transient-reduced audio signal such that a given temporal signal portion of the processed version of the transient-reduced audio signal is dependent on a plurality of temporally non-overlapping temporal signal portions of the transient-reduced audio signal. In other words, it is advantageous that the signal processor comprises temporal memory when generating the signal portions of the processed version of the transient-reduced audio signal. Signal processing using a memory allows for a block-wise procession of the transient-reduced audio signal, or for a temporal filtering (e.g. FIR-filtering, or HR-filtering) of the transient-reduced audio signal. It has also been found that the inventive concept of replacing transient signal portions is very well adapted for working in cooperation with such a signal processor. While transients would normally have a significant negative impact on the described signal processor performing a block-wise processing or having a temporal memory, the inventive replacement signal portions reduce this detrimental effect of the transient. While a transient would normally have an impact on multiple signal portions provided by the signal processor—extending beyond the temporal limits of the transient signal portion—the detrimental effect of a transient is reduced or even eliminated by the inventive concept. By maintaining a smooth temporal evolution of the energy of the transient-reduced signal, any degradation can be kept sufficiently smooth. For example, a block (of the block-wise processing of the signal processor), which comprises a replacement signal portion (e.g. in addition to an original non-transient signal portion), is not severely degraded, as the replacement signal portion is energy-adapted to the rest of the block. Thus, the block in its entirety is only slightly affected by the elimination or reduction of the transient event. Further, a temporal filtering which would be negatively affected by a transient event, and also by a complete removal (e.g. in the form of a zero-forcing) of the transient signal portion, is left almost unaffected by the transient removal (or reduction) due to the usage of a replacement signal portion.

In an embodiment, the signal processor is configured to perform a time-block-based processing of the transient-reduced audio signal to obtain the processed version of the transient-reduced audio signal. The transient signal replacer is also configured to adjust the duration of the signal portion to be replaced by the replacement signal portion with a temporal resolution which is finer than the duration of a time-block, or to replace a transient signal portion having a temporal duration smaller than the duration of the time-block with a replacement signal portion having a temporal duration smaller than the duration of the time-block. Thus, the replacement suggested herein allows for a low distortion processing of audio signals, even if the length of the removed transient portions is different from the length of the time blocks.

In an embodiment, the signal processor is configured to process the transient-reduced audio signal in a frequency-dependent manner, so that the processing introduces transient-degrading frequency dependent phase shifts into the transient-reduced audio signal. However, even such transient degrading signal processing does not have a significant detrimental impact on the processed audio signal, as transients are typically processed separately from the processing of the transient-reduced audio signal. Accordingly, while a transient-degrading signal processing algorithm can be applied in the signal processor, the quality of the transients can be maintained using a separate processing of the transient and a reinsertion of the transients at a later stage of the processing.

In an embodiment, the transient signal replacer comprises a transient detector, wherein the transient detector is configured to provide a time-varying detection threshold for the detection of the transient in the audio signal, such that the detection threshold follows an envelope of the audio signal with an adjustable smoothing time constant. The transient detector is configured to change the smoothing time constant in response to the detection of a transient and/or in dependence on a temporal evolution of the audio signal. By using such a transient detector, it is possible to detect transients of different intensities, even if transients are closely spaced in time. For example, the inventive concept allows for the detection of a weak transient, even if the week transient closely follows a preceding stronger transient. Accordingly, the transient detection for the transient replacement can be performed in a reliable and precise manner.

In an embodiment, the apparatus comprises a transient processor configured to receive a transient information representing the transient content of the transient signal portion. In this case, the transient processor may be configured to obtain, on the basis of the transient information, a processed transient signal in which tonal components are reduced. The transient signal re-inserter may be configured to combine the processed version of the transient-reduced audio signal with the processed transient signal provided by the transient processor. Thus, the separate processing of the transient-reduced audio signal and of the transient component of the input audio signal (represented by the transient information) can be performed in such a way that a subsequent combination of the different signal portions results in an appropriate overall output signal. These signal components of the transient signal portion which have been processed by the "main" signal processor (e.g. tonal signal components), do not need to be included in the separate processing of the transient. Accordingly, appropriate sharing of the processing of the audio components of the transient signal portion can be performed.

Further embodiments according to the invention create a method and a computer program for manipulating an audio signal comprising a transient event.

BRIEF DESCRIPTION OF THE DRAWINGS

Embodiments according to the invention will subsequently be described taking reference to the enclosed figures, in which.

DETAILED DESCRIPTION OF THE INVENTION

Figure 7:
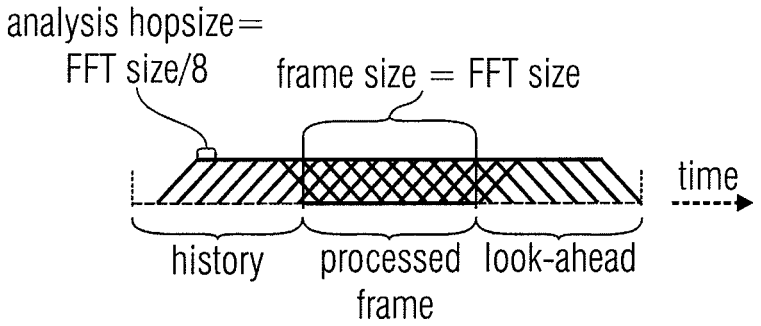
FIG. 7 shows a schematic representation of the operation of a phase-vocoder algorithm with synthesis hop size being different from analysis hop size, for example by a factor of 2.
Figure 7:
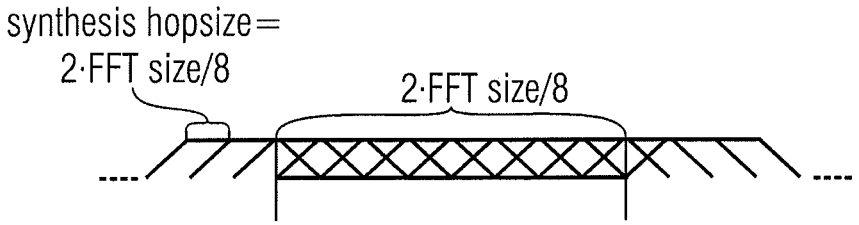
Figure 8:
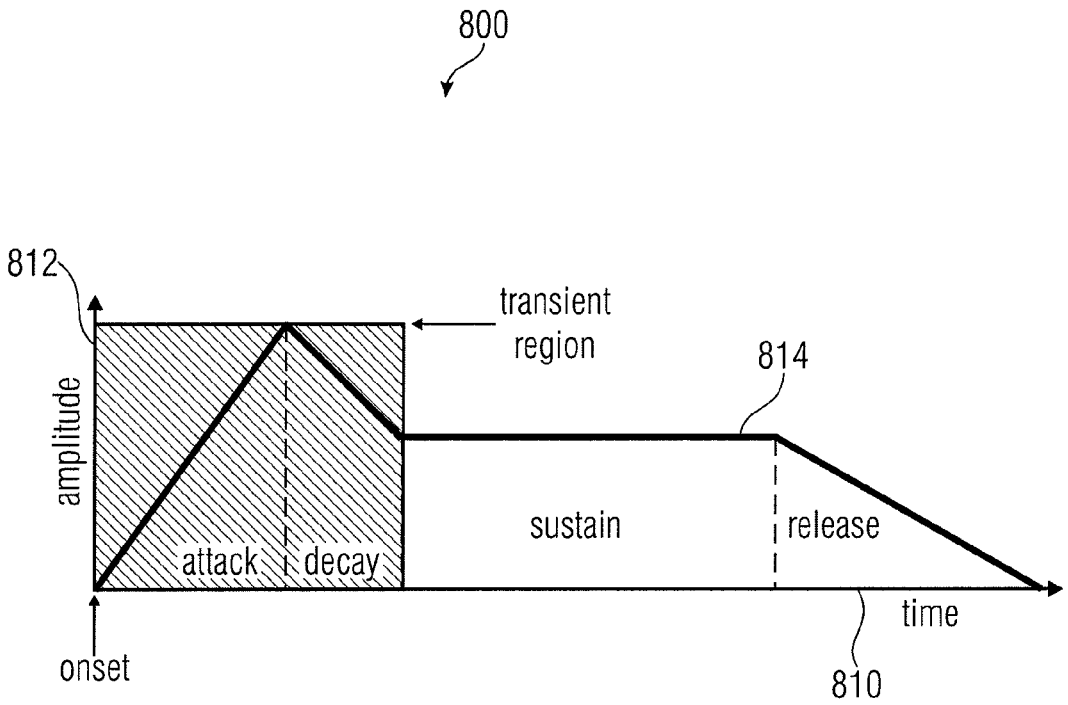
FIG. 8 shows a graphical representation of a temporal evolution of the amplitude of an audio signal.
Figure 9:
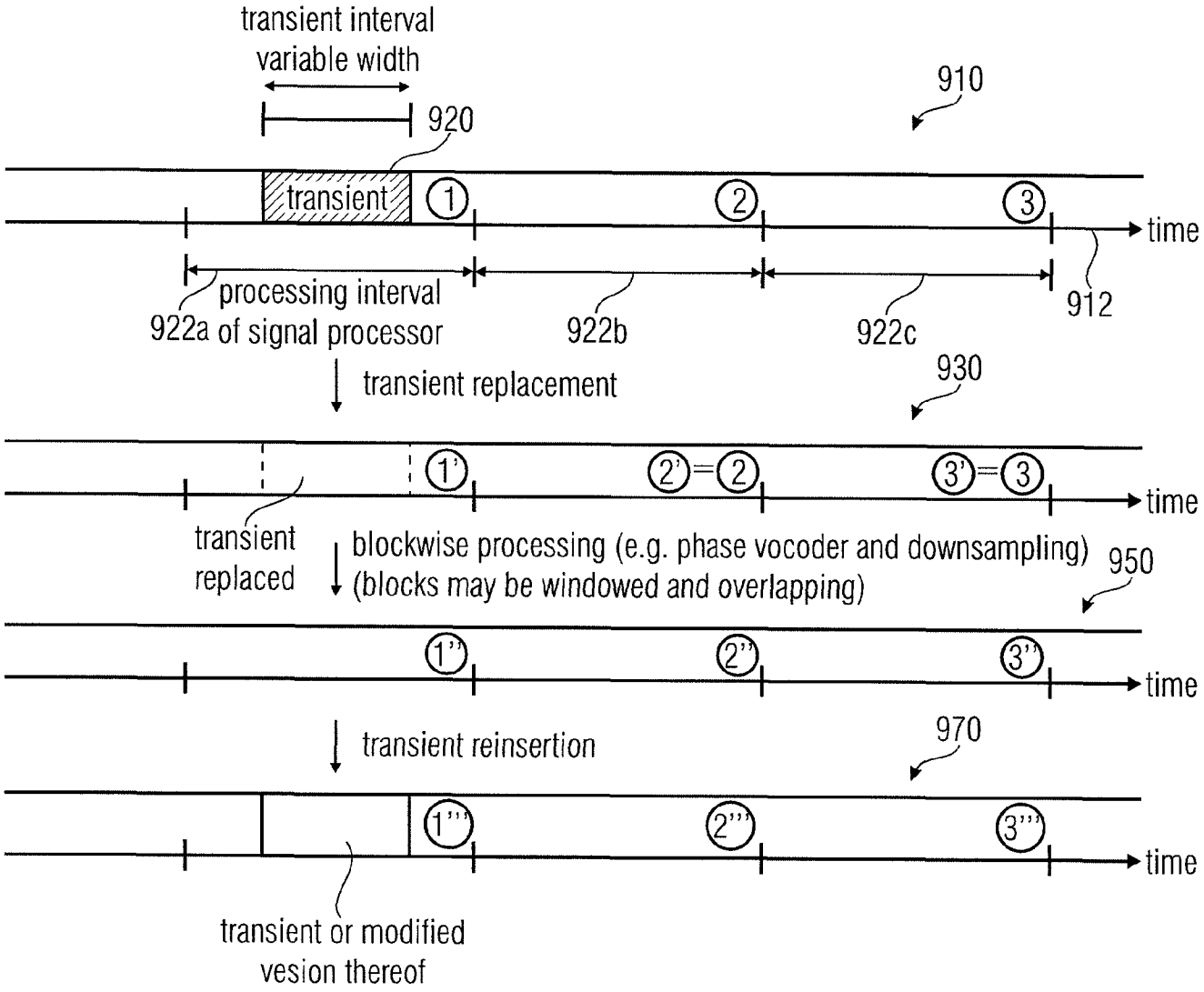
FIG. 9 shows a graphical representation of a timing of the signal processing in the apparatus of FIG. 1.
Figure 10:
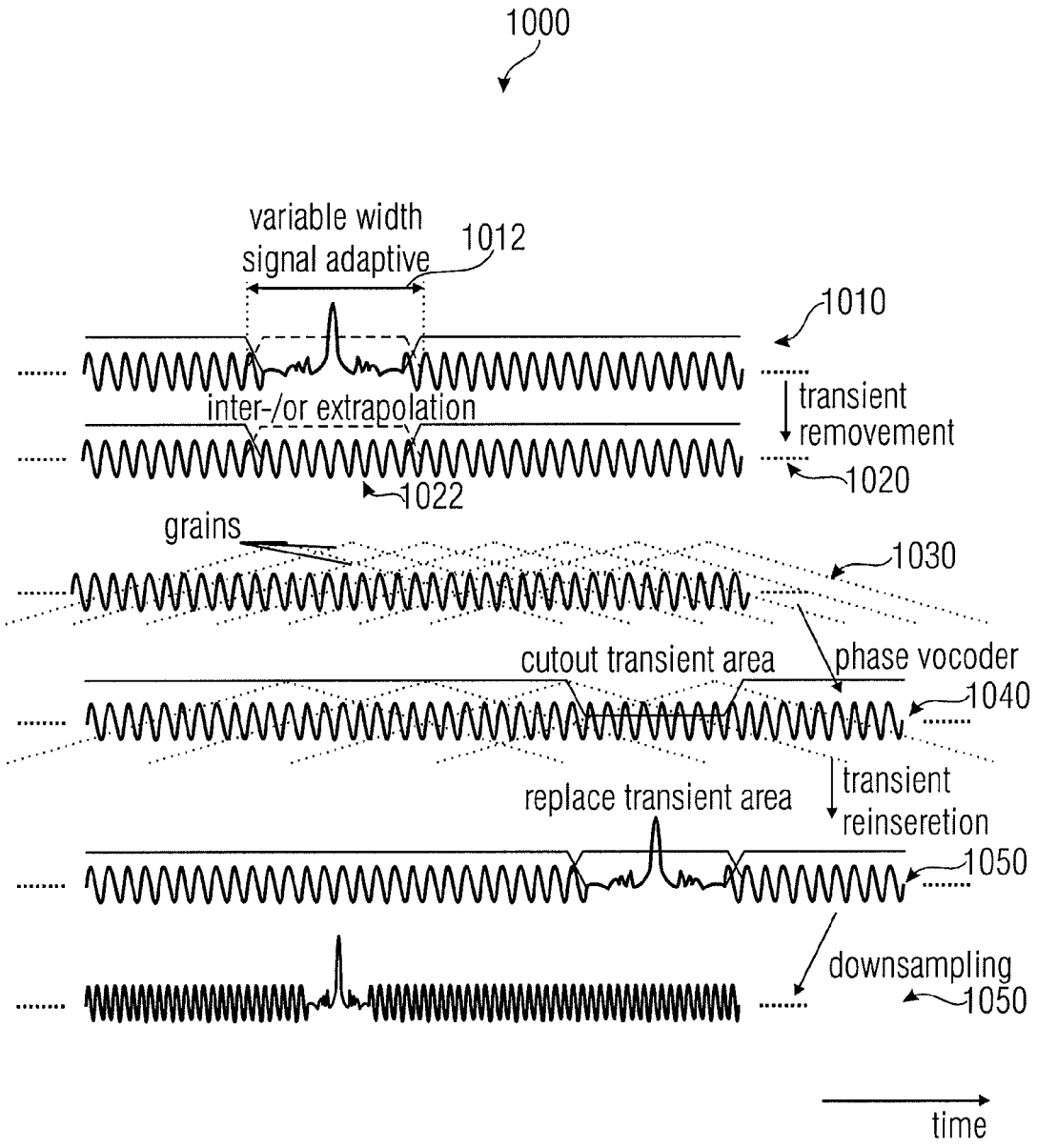
FIG. 10 shows a graphical representation of signals which may appear in an apparatus according to FIG. 1.
Figure 11:
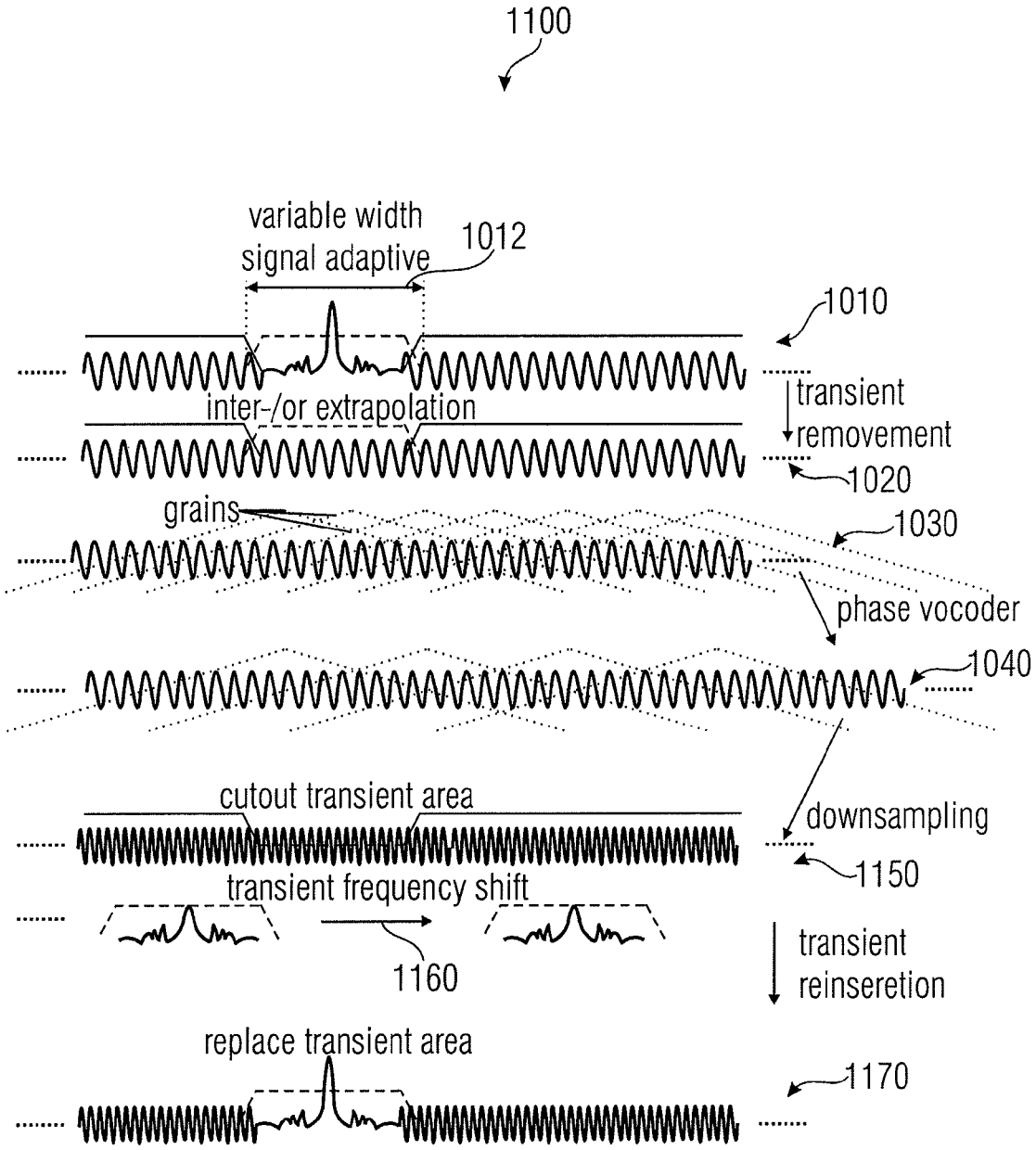
FIG. 11 shows another graphical representation of signals which may appear in an apparatus according to FIG. 1.
Figure 12:
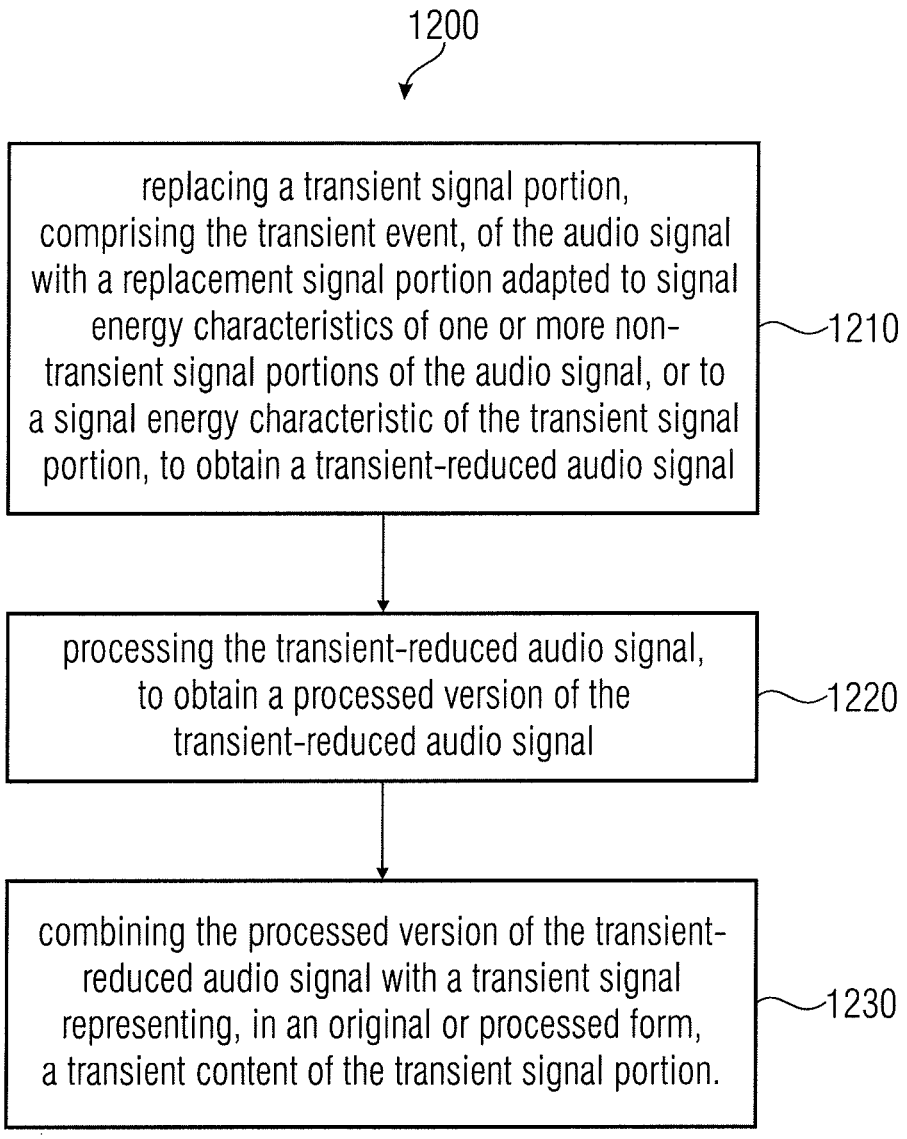
FIG. 12 shows a flowchart of a method for manipulating an audio signal, according to an embodiment of the present invention.

In the following, some embodiments according to the invention will be described. A first embodiment of an apparatus for manipulating an audio signal comprising a transient event will be described with reference to FIG. 1, which shows an overview of the first embodiment, also with reference to FIGS. 2, 3*a* to 3*c*, 4, 5*a*, 5*b*, 5*c*, 6 and 7, which show details of the components of the first embodiment and the operation of the phase vocoder (FIG. 7). A transient signal is shown in FIG. 8, and the processing thereof is illustrated in FIGS. 9 to 11. FIG. 12 shows a flow chart of a corresponding method.

Subsequently, the operation of a second embodiment of an apparatus for manipulating an audio signal comprising a transient event will be described taking reference to FIGS. 13 to 17.

Figure 1:
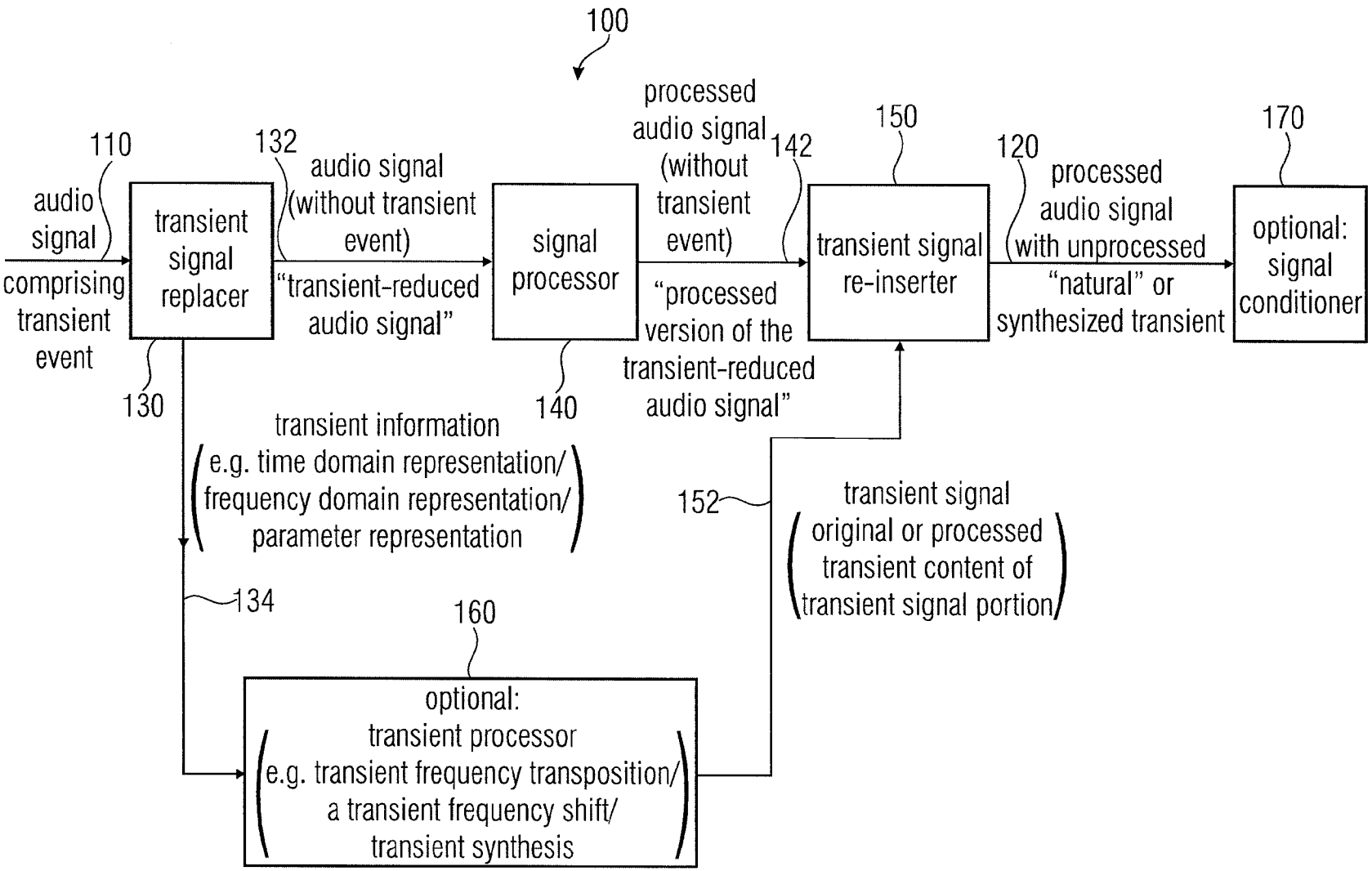
FIG. 1 shows a block-schematic diagram of an apparatus for manipulating an audio signal comprising a transient event, according to an embodiment of the present invention.

Embodiment According to FIG. 1

FIG. 1 shows a block schematic diagram of an apparatus for manipulating an audio signal comprising a transient event, according to an embodiment of the invention. The apparatus shown in FIG. 1 is designated in its entirety with 100. The apparatus 100 is configured to receive an audio signal 110 comprising a transient event, and to provide, on the basis thereof, a processed audio signal 120 with an unprocessed "natural" or synthesized transient. The apparatus 100 comprises a transient signal replacer 130 configured to replace a transient signal portion, comprising the transient event of the audio signal 110, with a replacement signal portion adapted to signal energy characteristics of one or more non-transient signal portions of the audio signal, or to a signal energy characteristic of the transient signal portion, to obtain a transient reduced audio signal 132. Optionally, phase characteristics of the replacement signal portion may be adapted to phase characteristics of one or more non-transient signal portions of the audio signal. The apparatus 100 further comprises a signal processor 140 configured to process the transient-reduced audio signal 132, to obtain a processed version 142 of the transient-reduced audio signal. The apparatus 100 further comprises a transient signal re-inserter 150 configured to combine the processed version 142 of the transient-reduced audio signal with a transient signal 152 to obtain the processed audio signal 120 with unprocessed "natural" or synthesized transient. The transient signal 152 may represent, in an original or processed form, a transient content of the transient signal portion, which has been replaced with the replacement signal portion by the transient signal replacer 130.

The transient signal replacer 130 may further, optionally, provide a transient information 134 representing the transient content of the transient signal portion (which is replaced by the replacement signal portion in the transient-reduced audio signal 132). Accordingly, the transient information 134 may serve to "save" the transient content of the audio signal 110, which is reduced or even completely suppressed in the transient reduced audio signal 132. The transient information 134 may be forwarded directly to the transient signal re-inserter 150, to serve as the transient signal 152. However, the apparatus 100 may further comprise an optional transient processor 160, which is configured to process the transient information 134, to derive the transient signal 152 therefrom. For example, the transient processor 160 may be configured to perform a transient frequency transposition, a transient frequency shift, or a transient synthesis.

The apparatus 100 may further comprise, optionally, a signal conditioner 170 configured to condition the processed audio signal 120 to obtain a conditioned audio signal for reproduction.

Regarding the functionality of the apparatus 100, it can generally be said that the apparatus 100 allows for a separate processing of a non-transient audio content of the audio signal 110 (represented by the transient-reduced audio signal 132), and of a transient audio content of the audio signal 110 (represented by the transient information 134). Transient events are reduced, or even suppressed, in the transient-reduced audio signal 132, such that the signal processor 140 may perform a signal processing which would degrade transient events and/or which would be detrimentally affected by transient events. However, by replacing transient signal portions with energy-adapted replacement signal portions, the transient signal replacer 130 serves to avoid audible artifacts, which would be introduced by the signal processor 140, if transient signal portions would simply be set to zero.

An appropriate hearing impression is also obtained using a transient re-insertion by the transient signal re-inserter 150. Of course, a hearing impression would typically be seriously degraded, if transient events were simply eliminated. For this reason, transients are re-inserted into the processed audio signal 142. The re-inserted transients may be identical to the transients removed from the audio signal 110 by the transient signal replacer 130.

Alternatively, a processing of said removed (or replaced) transients may be performed, for example in the form of a frequency transposition or frequency shift. However, in some embodiments the re-inserted transients may even be synthetically generated, for example on the basis of transient parameters describing a time and intensity of the transients to be re-inserted.

Transient Signal Replacer Details

Figure 2:
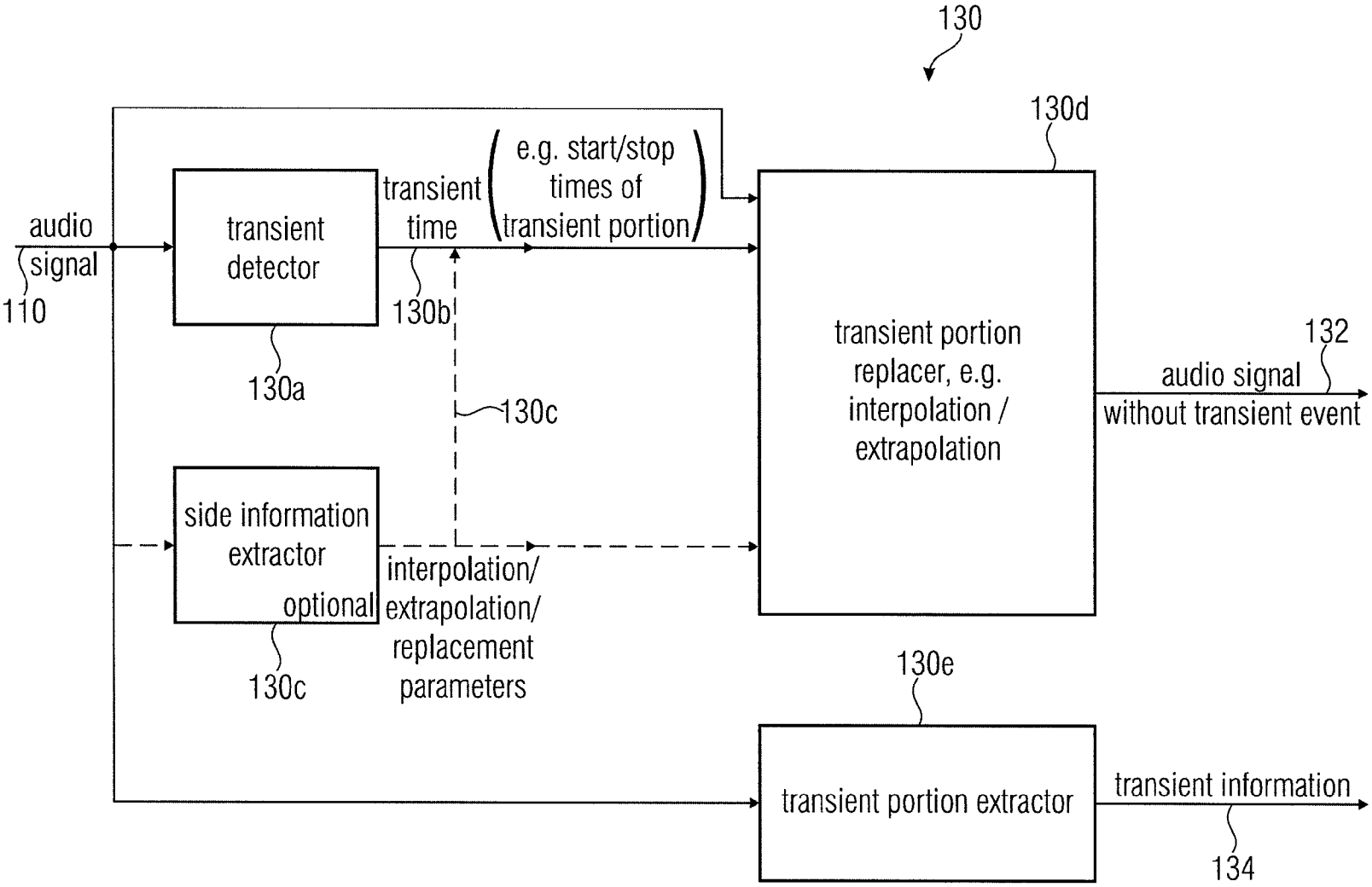
FIG. 2 shows a block-schematic diagram of a transient signal replacer, according town embodiment of the present invention.

In the following, the functionality of the transient signal replacer 130 will be described taking reference to FIG. 2, wherein FIG. 2 shows a block schematic diagram of an embodiment of the transient signal replacer 130. The transient signal replacer 130 receives the audio signal 110 and provides, on the basis thereof, the transient-reduced audio signal 132.

For this purpose, the transient signal replacer 130 may for example comprise a transient detector 130*a* which is configured to detect a transient and to provide an information about a timing of the transient. For example, the transient detector 130*a* may provide an information 130*b* describing a start time and an end time of a transient signal portion. Different concepts for transient detection are known in the an, such that a detailed description will be omitted here. However, in some cases the transient detector 130*a* may be configured to distinguish transients of different length such that the length of a recognized transient signal portion may vary in dependence on the actual signal shape.

Alternatively, the transient signal replacer may comprise a side information extractor 130*c*, for example, if a side information describing a timing of transients is associated with the audio signal 110. In this case, the transient detector 130*a* may naturally be omitted. The side information extractor 130*c* may further, optionally, be configured to provide one or more interpolation parameters, extrapolation parameters and/or replacement parameters on the basis of the side information associated with the audio signal 110. The transient replacer 130 further comprises a transient portion replacer 130*d*, for example a transient portion interpolator or a transient portion extrapolator. The transient portion replacer 130*e* is configured to receive the audio signal 110 and the transient time information 130*b* (provided by the transient detector 130*a* or by the side information extractor 130*c*) and to replace a transient portion of the audio signal 110 by a replacement signal portion.

In the following, details regarding the detection and replacement (or removal) of transients will be described. In particular, different methods for transient removal will be discussed in detail.

Transients (for example the onset of an instrument or percussive signals) may generally be described as a short time interval during which the signal rapidly develops in an unpredictable manner. For example, a transient may be detected (using the transient detector 130*a*) by evaluating a time domain representation of the audio signal 110. If the time domain representation of the audio signal 110 exceeds a threshold (which may be time-varying), then the presence of a transient event may be indicated. A temporal region comprising the transient event may be considered as a transient signal portion, and may be described by the transient time information 130*b*.

Since such signal portions (i.e. transients, or time intervals during which the signal rapidly develops in an unpredictable manner), are ideally not to be stretched in time, it is advantageous to remove "a transient time period" from the signal prior to the time stretching (which may be performed by the signal processor 140). Suppression may take place during the entire period of time which is considered "non-stationary". For percussive instruments this time period mostly consists of the entire sound event (e.g. a single HiHat beat). For the onset of an instrument, a so-called ADSR (Attack Decay Sustain Release) envelope may serve to illustrate the transient time period.

FIG. 8 shows a graphical representation 800 of a temporal evolution of a signal amplitude. An abscissa 810 describes a time, and an ordinate 812 describes an amplitude. A curve 814 describes a temporal evolution of the amplitude. As can be seen from FIG. 8, the temporal evolution of the amplitude comprises an attack-interval, a decay interval, a sustain interval and a release interval. The attack interval and the decay interval may for example be considered as a "transient region" or transient signal portion.

However, it has been found that for further signal processing (e.g. in the signal processor 140), the gap in the audio signal which is caused by transient suppression should be filled such that when listening to the processed signal (=synthesis signal) (e.g. processed using the signal processor 140), there is the auditory sensation of a continuous, transient, free signal without disruptive pauses and amplitude modulations.

For the specific case of application described herein, it is advantageous to suppress all transient portions of the original signal (e.g. signal 110) in the synthesis signal (e.g. in the signal 132 provided to the signal processor 140 or, consequently, in the signal 142 provided by the signal processor 140), whereas tonal portions and non-transient noise components continue to exist.

On this subject, there are various approaches which already exist, but a goal of which is never a high-quality transient-adjusted (or transient-purged) signal. Regarding this issue, reference is made to the publication [Edler], for example.

With regard to the efficiency of transient detection methods and the decomposition into various components, such as for example "transients+noise", the following conclusions can be drawn from the respective specialist publications [Bello] and [Daudet], which provide a good overall view of the common methods: none of the methods is clearly superior to the others; selection should be governed by the respective application and by the computing power available.

It follows that the selection of specific detection and decomposition methods may significantly influence the result of the inventive method. For those skilled in the art, it is readily possible to apply any of the various known methods so as to provide the best condition possible for the respective application scenario.

Concepts for Transient Portion Replacement

Some application scenarios are about generating signal portions which need not be evaluated as "right" or "wrong" by verification with a reference signal, but only on the basis of their good overall sound. This means that embodiments according to the invention are not limited to separating the portions, and to omitting the transient components, but may generate themselves synthesis signals having specific properties.

Synthesis signal generation (e.g. generation of a transient-reduced signal 132 by the transient signal replacer 130*d*) may therefore be a combination of signal decomposition and signal generation (in the sense of an interpolation and/or extrapolation of the assumed signal) during the transient time period. Non-transient components of the original signal may be mixed with the interpolated/extrapolated components, or may replace same.

In some embodiments according to the present invention, extrapolation may be equal to a synthesis signal generation using past values. Accordingly, extrapolation may be real-time capable. In contrast, in some embodiments, interpolation may be equal to a synthesis signal generation using preceding and subsequent values. Thus, in some cases, the interpolation may need a look-ahead.

To summarize the above, different concepts may be applied in the transient portion replacer 130*d* to obtain the transient reduced audio signal 132.

For example, the transient portion replacer 130*d* may be configured, to reduce the transient components from the audio signal 110, to obtain the transient-reduced audio signal. In this case, the transient portion replacer 130*d* may be configured to ensure that a sufficient energy remains in the replacement signal portion, taking the place of the transient signal portion. For example, frequency components which comprise a transient phase characteristic may be removed from the audio signal 110, while other frequency components which do not comprise the transient phase characteristic (e.g. tonal frequency components) may be taken over from the transient signal portion into the replacement signal portion. Accordingly, it may be ensured that the replacement signal portion comprises a sufficient signal energy, which does not deviate too strongly from the signal energy of the preceding and subsequent signal portions.

Alternatively, the transient portion replacer 130*d* may be configured to obtain the replacement signal portion by destroying the transient shaping phase relationship in the transient signal portion. For example, the transient portion replacer may be configured to randomize or (deterministically) adjust the phase of the different frequency components of the transient signal portion. Accordingly, the replacement signal portion obtained in this manner may comprise (at least approximately) the same energy as the transient signal portion (as a phase modification of frequency components does not change the energy). However, the transient-shaped temporal evolution of the time signal described by the replacement signal portion may be lost due to the transient temporal evolution being based on a specific phase relation of different frequency components, which is destroyed.

Alternatively, however, the transient portion replacer 130*d* may interpolate, for example, a temporal evolution of the energy in different frequency bands on the basis of a non-transient signal portion preceding the transient signal portion. Accordingly, the content of the replacement signal portion may be merely based on an extrapolation of the content of a non-transient signal portion preceding the transient signal portion. Accordingly, the content of the transient signal portion may be completely disregarded.

Alternatively, however, the content of the replacement signal portion may be obtained, using the transient portion replacer 130*d*, by interpolating between a content of a non-transient signal portion preceding the transient signal portion and a non-transient signal portion following the transient signal portion. Again, the content of the transient signal portion may be completely disregarded. The interpolation may be performed, for example, in a time-frequency domain.

Alternatively, however, a combination of the above described methods may be used to obtain the content of the replacement signal portion. For example, a non-transient content of the transient signal portion (extracted for example by removing the transient content or by destroying the transient-forming phase relationship) may be combined with an audio signal content obtained by interpolating or extrapolating one or more transient signal portions. As another example, a transient-forming phase relationship in a transient signal portion may be destroyed and an energy of the transient signal portion may be scaled to be adapted to an energy of adjacent non-transient signal portions.

In view of the above, it can be said that the replacement signal portion is synthesized either on the basis of non-transient signal portions only (e.g. preceding and/or following the transient signal portion)(without using the content of the transient signal portion), on the basis of the transient signal portion only, or on the basis of a combination of one or more non-transient signal portions and the transient signal portion.

Further Concept for the Generation of the Transient-reduced Audio Signal—Basics

In the following, a further concept for the generation of the transient-reduced audio signal 132 will be described, aspects of which can be applied in any embodiments described herein. With regard to the process of detecting and substituting, reference is made to WO 2007/118533, which is incorporated herein in its entirety by reference.

WO 2007/118533 A1 describes an apparatus and a method for a production of a surrounding-area signal. This document describes a transient detector, which is provided in order to detect a transient time period. The transient detector described in WO 2007/118533 A1 may for example be used to implement (or replace) the transient detector 130*a* described herein. The said publication further describes a synthesis signal generator, which produces a synthesis signal which satisfies a transient condition and a continuity condition. The synthesis generator described in WO 2007/118533 A1 may for example be used to implement the transient portion replacer 130*d*, or may even take the place of the transient portion replacer 130*d*. Thus, the concept described in WO 2007/118533 A1, for the generation of a synthesis signal, can be used for the generation of the transient-reduced audio signal 132 in some embodiments of the present invention.

Further Concept for the Generation of the Transient-reduced Audio Signal—Extensions As in the application described here (processing of a signal comprising a transient, while maintaining a good hearing impression), high audio quality of the resulting signal is substantially more critical than in the application of WO 2007/118533 (Ambient Signal Generation), the method described in WO 2007/118533 is expanded by some steps, in order to improve audio signal quality.

For example, in addition to amplitude extrapolation, an embodiment according to the present invention may also comprise extrapolating or interpolating the phase values so as to obtain a synthesis signal of improved quality, which has no transient portions.

Extrapolation or interpolation is performed, e.g. using a linear prediction or linear prediction coding (LPC), or linearly and/or with splines or the like+weighted noise.

In some embodiments, the above described generation of the transient-reduced audio signal 132 may be particularly advantageous when used in combination with a phase vocoder, which may be part of the signal processor 140, or which may constitute the signal processor 140. In some embodiments, the property of the phase vocoder—which is usually considered to be a big problem [8]—which consists in that no predictable relationship exists to the preceding frames during transients, is exploited. In some embodiments, this very fact is exploited so as to suppress the transient in that the transient is erased by forcing a relationship with the preceding bins. In other words, the phase of different coefficients describing the different time-frequency bins of the replacement signal portion (e.g. in the form of complex numbers) are, for example, adjusted by extrapolating from preceding time-frequency bins (of a preceding non-transient signal portion), or interpolating between corresponding time-frequency bins of a preceding non-transient signal portion and a following non-transient signal portion. In the publication [Maher] a comparable interpolation method is described. The method presented in [Maher] is not real-time capable, since portions which follow the signal gap are also needed. In addition, [Maher] only describes processing of the "peaks" in an audio signal (by contrast, some embodiments according to the invention process all frequency lines), and noise components are not dealt with explicitly either. In other words, in some embodiments the concept described in [Maher] for the bridging of gaps in an audio signal may be applied with the present application to obtain the transient-reduced audio signal 132, on the basis of the original input audio signal 110. Rather than bridging a "missing" portion of an audio signal, a portion identified as a transient signal portion may be replaced using the method described in [Maher]. However, the interpolation/extrapolation may be performed independently for every frequency bin. Optionally, amplitude and phase may be interpolated (e.g. separately).

Transient Detector 130*a*

In the following, some present details regarding the transient detector 130*a* will be described. However, it should be noted that many different implementations of the transient detector 130*a* can be used, such that the following details should be considered as examples of one advantageous implementation. In some embodiments, adaptive thresholds are advantageous for recognizing the transient time periods. Normally, adaptive thresholds are smoothed versions of a detection function, which may result in major fluctuations and, therefore, in non-detection of small peaks in the surroundings of large peaks. For details, reference is made to the publication [Bello]. This problem may be solved, for example, by suitable adaptation of the smoothing constants in dependence on the currently detected condition (transient region/no transient region) and on the development of the detection function (e.g. attack, decay).

In the following, some literature references regarding the abovementioned aspects will be given: [Edler], [Bello], [Goodwin], [Walther], [Maher], [Daudet].

Transient Portion Extractor 130*e*

In addition to the functionalities described above, the transient signal replacer 130 may further comprise a transient portion extractor 130*e*, which transient portion extractor 130*e* may be configured to receive the audio signal 110 (or at least the transient signal portion thereof), and to provide the transient information 134. The transient portion extractor 130*e* may be configured to provide the transient information 134 in any possible form, e.g. in the form of a transient-signal-portion-time-signal, in the form of a transient-signal-portion-time-frequency-domain-representation, or in the form of transient parameters (e.g. a transient time information and/or a transient intensity information and/or a transient steepness information and/or any other appropriate transient information).

In particular, the transient portion extractor 130*e* may be configured to provide the transient information 134 only for the signal portions which have been removed from the audio signal 110 to obtain the transient-reduced audio signal 132, in order to keep the data rate reasonably small.

Implementation Alternatives for the Signal Processor 140—Overview

Figure 3A:
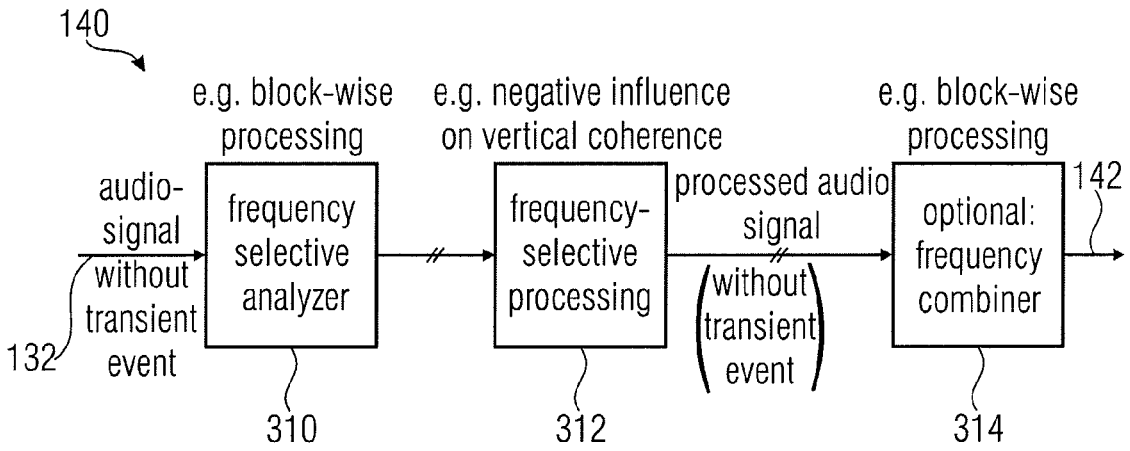
FIGS. 3*a*-3*c* show block-schematic diagrams of a signal processor, according to embodiments of the present invention.

In the following, different basic concepts for the implementation of the signal processor 140 will be described. FIG. 3*a* illustrates an implementation of the signal processor 140 of FIG. 1. This implementation comprises a frequency-selective analyzer 310 and a subsequently-connected frequency selective processing device 312 that is implemented such that it supplies a negative influence on the "vertical coherence" of the original audio signal. An example for this frequency-selective processing is the stretching of a signal in time or the shortening of a signal in time, where this stretching or shortening is applied in a frequency-selective manner so that, for example, the processing introduces phase shifts into the processed audio signal, which are different for different frequency bands. The phase shifts may, for example, be introduced such that transients are degraded. The signal processor 140 shown in FIG. 3*a* may further, optionally, comprise a frequency combiner 314 which is configured to combine the different frequency components of the processed audio signal provided by the frequency selective processing 312 into a single signal (e.g. a time-domain signal).

Both the frequency selective analyzer 310, which may split up the transient-reduced audio signal 132 into a plurality of frequency components (e.g. complex-valued spectral coefficients) and the frequency combiner 314, which may be configured to obtain the time-domain representation of the processed audio signal 142 on the basis of a plurality of complex-valued spectral coefficients for different frequency bands, may be configured to perform a block-wise processing. For example, the frequency selective analyzer 310 may process a (e.g. windowed) block of samples of the audio signal 132, to obtain a set of complex-valued spectral coefficients representing the audio content of the block of audio signal samples. Similarly, the optional frequency combiner 314 may receive a set of complex-valued coefficients (e.g. one for each frequency band out of a plurality of frequency bands) and to provide, on the basis thereof, a time-domain representation over a limited interval of time comprising a plurality of time domain samples.

Figure 3B:
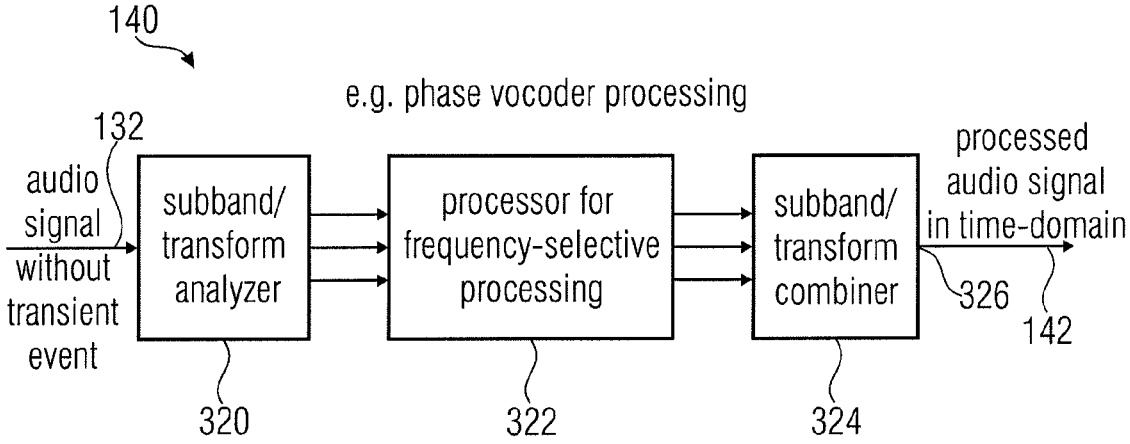

Another signal processing is illustrated in FIG. 3*b* in the context of a phase vocoder processing. Generally, a phase vocoder comprises a subband/transform analyzer 320, a subsequently connected processor 322 for performing a frequency-selective processing of a plurality of output, signals provided by the analyzer 320, and subsequently a subband/transform combiner 324 which combines the signals processed by the processor 322 in order to finally obtain a processed signal 142 in the time domain at an output 326. The processed signal 142 in the time domain, again, is a full bandwidth signal for a lowpass filter signal as long as the bandwidth of the processed signal 142 is larger than the bandwidth represented by a single branch between item 322 and 324, since the subband/transform combiner 324 performs a combination of frequency-selective signals.

Further details on this phase vocoder will be discussed below in connection with FIGS. 5*a*, 5*b*, 5*c*, and 6.

Figure 3C:
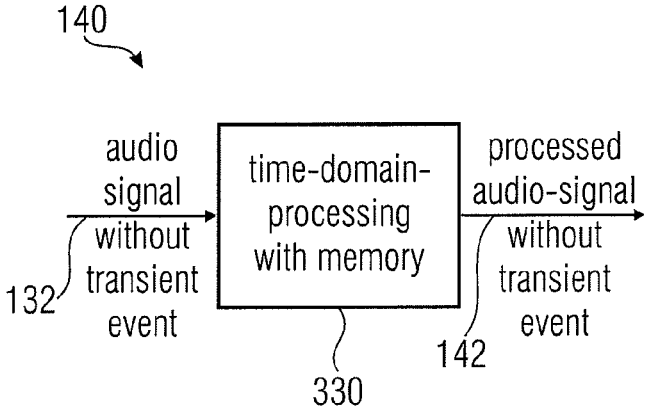

FIG. 3*c* shows another possible implementation of the signal processor 140. As can be seen, the transient-reduced audio signal 132 may even be processed in the time-domain in some embodiments. Typically, the time-domain processing 330 may comprise a memory, such that a transient in the signal 132 would have a long-duration impact on the processed audio signal 142. In some cases, the transient-reduced audio signal 132 would cause a transient-response in the processed audio signal 142, which is significantly longer (e.g. by a factor of 2, or even by a factor of 5, or even by a factor of 10 longer) than the duration of the transient (or the duration of the transient signal portion). In this case, transients in the audio signal 132 would significantly degrade, in an undesirable manner, the processed audio signal 142, for example by producing audible echoes. Further, a complete deletion of a transient signal portion would also have a long-duration impact on the processed audio signal 142, because a complete deletion of a transient signal portion causes a transient itself.

Figure 5A:
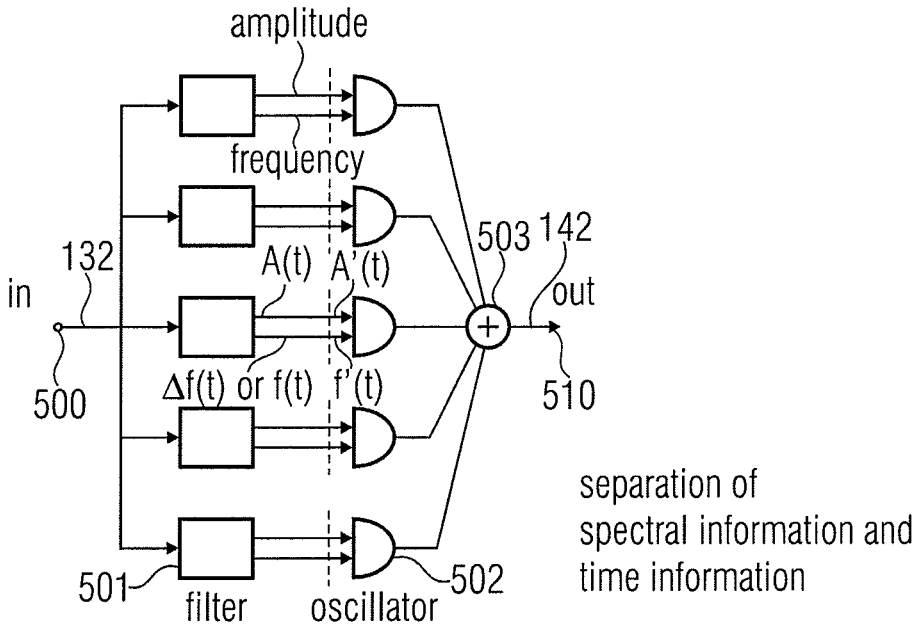
FIG. 5*a* shows an overview of the implementation of a vocoder to be used in the signal processor of FIG. 1.

Implementation of the Signal Processor Using a Vocoder—Filterbank Implementation In the following, with reference to FIGS. 5 and 6, implementations for a vocoder, which can be used for an implementation of the signal processor 140, or which may be a part of the signal processor 140, are illustrated. FIG. 5*a* shows a filterbank implementation of a phase vocoder, wherein an input audio signal (e.g. the transient-reduced audio signal 132) is fed in at an input 500 and a processed audio signal (e.g. the processed audio signal 142) is obtained at an output 510. In particular, each channel of the schematic filterbank illustrated in FIG. 5*a* includes a bandpass filter 501 and a downstream oscillator 502. Output signals of all oscillators from every channel are combined by a combiner, which is for example implemented as an adder and indicated at 503, in order to obtain the output signal at the output 510. Each filter 501 is implemented such that it provides an amplitude signal on the one hand and a frequency signal on the other hand. The amplitude signal and the frequency signal are time signals illustrating a development of the amplitude in a filter 501 over time, while the frequency signal represents a development of the frequency of the signal filtered by a filter 501.

Figure 5B:
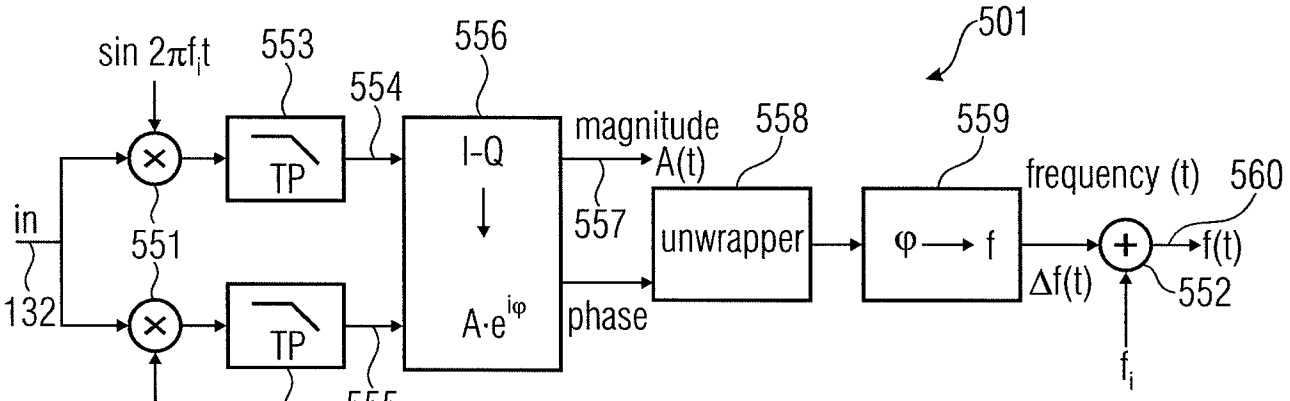
FIG. 5*b* shows an implementation of parts (analysis) of a signal processor of FIG. 1.

A schematical setup of filter 501 is illustrated in FIG. 5*b*. Each filter 501 of FIG. 5*a* may be set up as shown in FIG. 5*b*, wherein, however, only the frequencies $f_i$ supplied to the two input mixers 551 and the adder 552 are different from channel to channel. The mixer output signals are both lowpass filtered by lowpasses 553, wherein the lowpass signals are different insofar as they were generated by local oscillator signals, which are out of phase by 90°. The upper lowpass filter 553 provides a quadrature signal 554, while the lower filter 553 provides an in-phase signal 555. These two signals, i.e. I and Q, are supplied to a coordinate transformer 556 which generates a magnitude phase representation from the rectangular representation. The magnitude signal or amplitude signal, respectively, of FIG. 5*a* over time is output at an output 557. The phase signal is supplied to a phase unwrapper 558. At the output of the element 558, there is no phase value present any more which is between 0 and 360°, but a phase value which increases linearly. This "unwrapped" phase value is supplied to a phase/frequency converter 559 which may for example be implemented as a simple phase difference former which subtracts a phase of a previous point in time from a phase at a current point in time to obtain a frequency value for the current point in time. This frequency value is added to the constant frequency value $f_i$ of the filter channel i to obtain a temporarily varying frequency value at the output 560. The frequency value at the output 560 has a direct component=$f_i$ and an alternating component=the frequency deviation by which a current frequency of the signal in the filter channel deviates from the average frequency $f_i$.

Thus, as illustrated in FIGS. 5*a* and 5*b*, the phase vocoder achieves a separation of the spectral information and time information. The spectral information is in the special channel or in the frequency $f_i$ which provides the direct portion of the frequency for each channel, while the time information is contained in the frequency deviation or the magnitude over tithe, respectively.

Figure 5C:
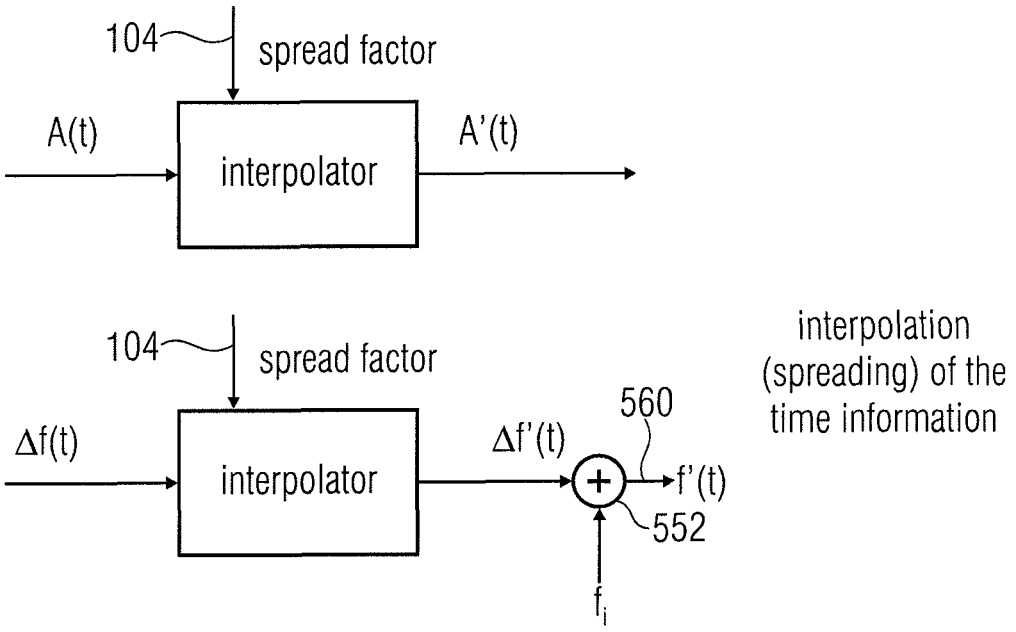
FIG. 5*c* illustrates other parts (stretching) of a signal processor of FIG. 1.

FIG. 5*c* shows a manipulation which may be performed in the vocoder at the location of the vocoder plotted in dashed lines in FIG. 5*a*.

For time scaling, e.g. the amplitude signals A(t) in each channel or the frequency of the signals f(t) in each signal may be decimated or interpolated, respectively. For purposes of transposition, as it is useful for the present invention, an interpolation, i.e. a temporal extension or spreading of the signals A(t) and f(t) is performed to obtain spread signals A'(t) and f' (t), wherein the interpolation is controlled by a spread factor. By the interpolation of the phase variation, i.e. the value before the addition of the constant frequency by the adder 552, the frequency of each individual oscillator 502 in FIG. 5*a* is not changed. The temporal change of the overall audio signal is slowed down, however, i.e. by the factor 2. The result is a temporally spread tone having the original pitch, i.e. the original fundamental wave with its harmonics.

For frequency transposition, the following concept can be used. By performing the signal processing illustrated in FIG. 5*c*, wherein such a processing is executed in every filter band channel in FIG. 5*a*, and by decimating the resulting temporal signal in a decimator, the audio signal can be shrunk back to its original duration while all frequencies are doubled simultaneously. This leads to a pitch transposition by the factor 2 wherein, however, an audio signal is obtained which has the same length as the original audio signal, i.e. the same number of samples.

Implementation of the Signal Processor Using a Vocoder—Transform Implementation

Figure 6:
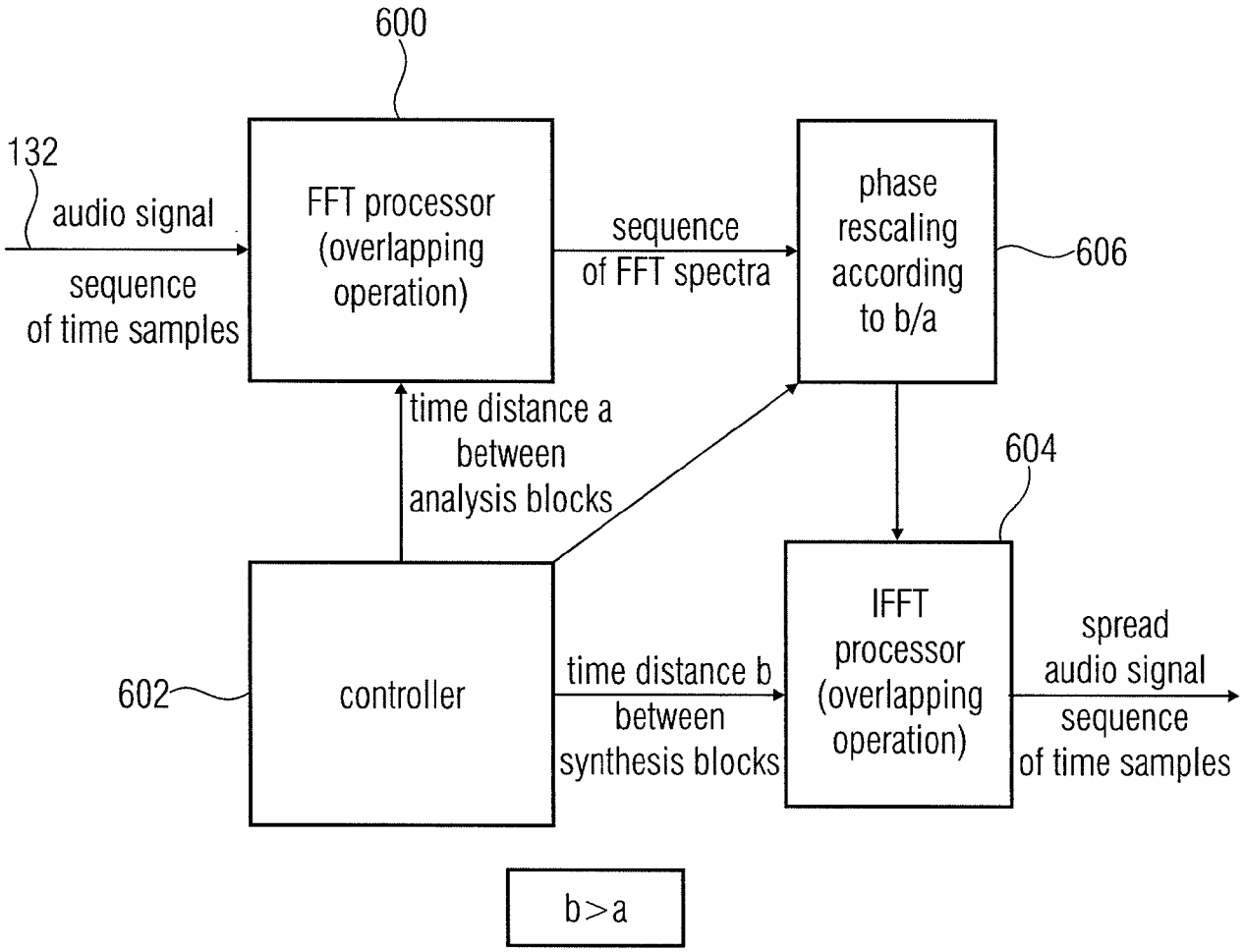
FIG. 6 illustrates a transform implementation of a phase vocoder to be used in the signal processor of FIG. 1.

As an alternative to the filterbank implementation illustrated in FIG. 5*a*, a transform implementation of a phase vocoder may also be used as depicted in FIG. 6. Here, the audio signal 132 is =fed into an FFT processor, or more generally, into a Short-Time-Fourier-Transform-Processor 600 as a sequence of time samples. The FFT processor 600 is implemented schematically in FIG. 6 to perform a time windowing of an audio signal in order to then, by means of an FFT, calculate magnitude and phase of the spectrum, wherein this calculation is performed for successive spectra which are related to blocks of the audio signal, which are strongly overlapping.

In an extreme case, for every new audio signal sample a new spectrum may be calculated, wherein a new spectrum may be calculated also e.g. only for each twentieth new sample. This distance a in samples between two spectra is advantageously given by a controller 602. The controller 602 is further implemented to feed an IFFT processor 604 which is implemented to operate in an overlapping operation. In particular, the IFFT processor 604 is implemented such that it performs an inverse short-time Fourier Transformation by performing one IFFT per spectrum based on magnitude and phase of a modified spectrum, in order to then perform an overlap add operation, from which the resulting time signal is obtained. The overlap add operation eliminates the effects of the analysis window.

A spreading of the time signal is achieved by the distance b between two spectra, as they are processed by the IFFT processor 604, being greater than the distance a between the spectrums in the generation of the FFT spectrums. The basic idea is to spread the audio signal by the inverse FFTs simply being spaced apart further than the analysis FFTs. As a result, temporal changes in the synthesized audio signal occur more slowly than in the original audio signal.

Without a phase resealing in block 606, this would, however, lead to artifacts. When, for example, one single frequency bin is considered for which successive phase values by 45° are implemented, this implies that the signal within this filterbank increases in the phase with a rate of 1/8 of a cycle, i.e. by 45° per time interval, wherein the time interval here is the time interval between successive FFTs. If now the inverse FFTs are being spaced farther apart from each other, this means that the 45° phase increase occurs across a longer time interval. This means that due to the phase shift a mismatch in the subsequent overlap-add process occurs leading to unwanted signal cancellation. To eliminate this artifact, the phase is resealed by exactly the same factor by which the audio signal was spread in time. The phase of each FFT spectral value is thus increased by the factor b/a, so that this mismatch is eliminated.

While in the embodiment illustrated in FIG. 5*c* the spreading by interpolation of the amplitude/frequency control signals was achieved for one signal oscillator in the filterbank implementation of FIG. 5*a*, the spreading in FIG. 6 is achieved by the distance between two IFFT spectra being greater than the distance between two FFT spectra, i.e. b being greater than a, wherein, however, for an artifact prevention a phase resealing is executed according to b/a.

With regard to a detailed description of phase-vocoders reference is made to the following documents:

"The phase Vocoder: A tutorial", Mark Dolson, Computer Music Journal, vol. 10, no. 4, pp. 14-27, 1986, or "New phase Vocoder techniques for pitch-shifting, harmonizing and other exotic effects", L. Laroche and M. Dotson, Proceedings 1999 IEEE Workshop on applications of signal processing to audio and acoustics, New Paltz, N.Y., Oct. 17-20, 1999, pages 91 to 94; "New approached to transient processing interphase vocoder", A. Röbel, Proceeding of the 6th international conference on digital audio effects (DAFx-03), London, UK, Sep. 8-11, 2003, pages DAFx-1 to DAFx-6; "Phase-locked Vocoder", Meller Puckette, Proceedings 1995, IEEE ASSP, Conference on applications of signal processing to audio and acoustics, or U.S. Pat. No. 6,549,884.

In the following, an example for the functionality of the transform-based phase vocoder will be briefly described taking reference to FIG. 7. FIG. 7 shows a schematic representation of the operation of a phase-vocoder algorithm with synthesis hop size being different from analysis hop size, for example by a factor of 2.

The phase vocoder (PV) algorithm is used to modify the duration of a signal without altering its pitch [B9]. It divides a signal into so-called grains which denote windowed cutouts of the signal with typically a length in the range of some ten milliseconds. The grains are rearranged in an overlap-and-add (OLA) process with a synthesis hop size that differs from the analysis hop size. In order to stretch the signal by a factor of two for instance, the synthesis hop size is twice the analysis hop size. FIG. 7 illustrates the algorithm.

Transient Signal Reinserter

Figure 4:
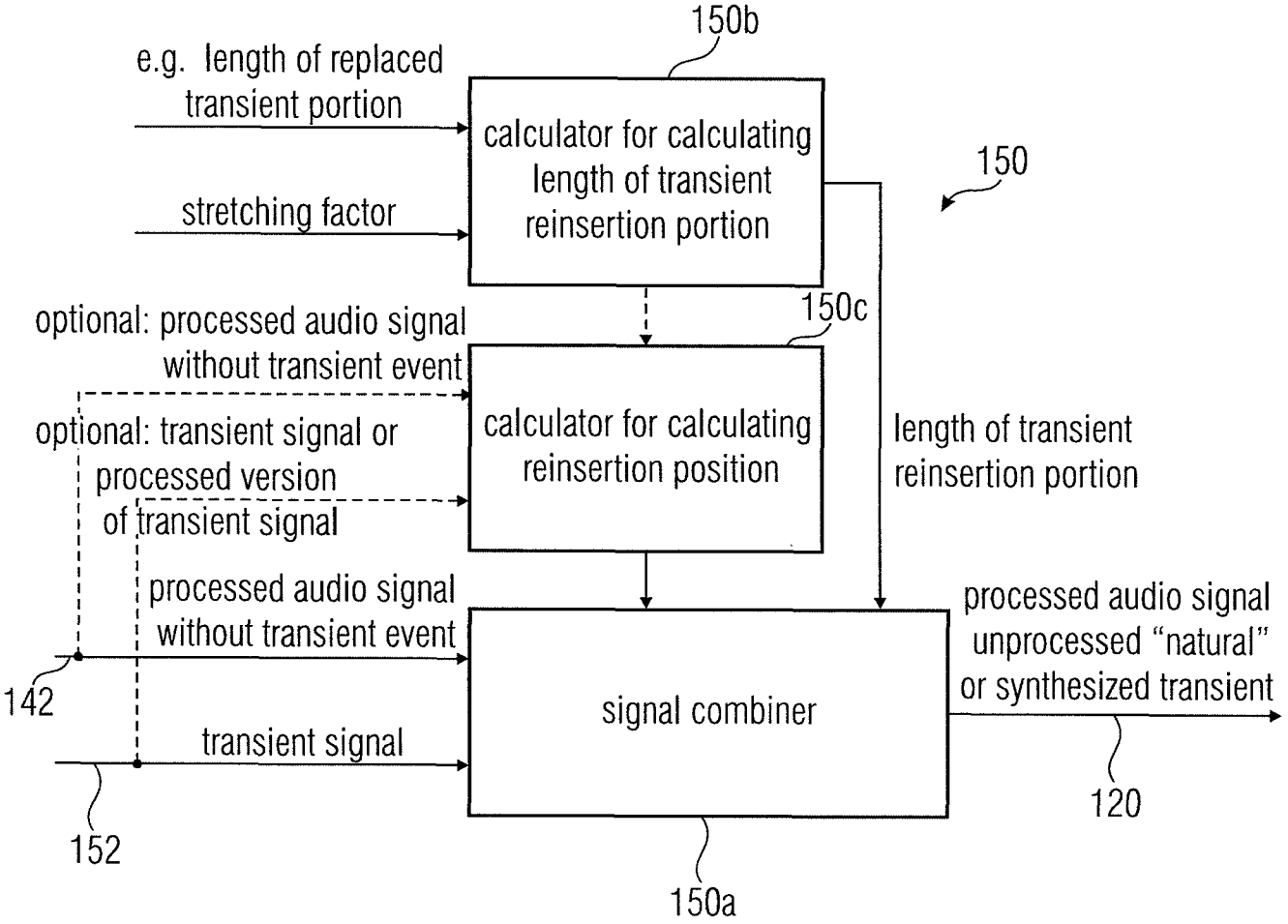
FIG. 4 shows a block schematic diagram of a transient signal re-inserter, according to an embodiment of the present invention.

In the following, an implementation of the transient signal re-inserter 150 shown in FIG. 1 will be described with reference to FIG. 4.

The transient signal re-inserter 150 comprises, as a key component, a signal combiner 150*a*. The signal combiner 150*a* is configured to receive both the processed audio signal 142 and the transient signal 152, and to provide, on the basis thereof, the processed audio signal 120. The signal combiner 150*a* may for instance be configured to perform a hard, switching replacement of a portion of the processed audio signal 142 by a portion of the transient signal 152. However, in an embodiment, the signal combiner 150*a* may be configured to form a cross-fading between the processed audio signal 142 and the transient signal 152, such that there is a smooth transition between said signals 142, 152 within the processed audio signal 120.

However, the transient signal re-inserter 150 may be configured to determine an optimal insertion coefficient. For example, the transient signal re-inserter 150 may comprise a calculator 150*b* for calculating a length of the transient re-insertion portion. The calculation of this length of the transient re-insertion portion may, for example, be important if the length of the replaced transient portion (as determined, e.g. by the transient detector 130*a*) is variable in dependence of the signal characteristics. In the case that the processed audio signal 142 comprises a different length (or different number of samples per second, or a different number of overall samples) when compared to the original input audio signal 110, a stretching factor or compression factor may be considered by the calculator 150*b* to determine the length of the transient re-insertion portion. A detailed discussion of this length variation will be provided below making reference to FIGS. 10 and 11.

The transient signal re-inserter 150 may further comprise a calculator 150*c* for calculating a re-insertion position. In some cases, the calculation of the re-insertion position may take into account a stretching or a compression of the processed audio signal 142. In some cases, it is advantageous that a relationship between a non-transient audio signal content and a transient signal content (e.g. temporal relationship) in the processed audio signal 120 is at least approximately identical to the temporal relationship of said non-transient audio content and said transient audio content in the original input audio signal 110. However, in addition to a pre-computation of the appropriate transient signal re-insertion position, a fine adjustment of said re-insertion position may be performed. For example, the calculator 150*c* for calculating the re-insertion positions may be configured to read both the processed audio signal 142 and the transient signal 152, and to determine a re-insertion time instance on the basis of a comparison of the processed audio signal 142 and the transient signal 152. Details regarding the possible calculation of the re-insertion position will be described below taking reference to the examples illustrated in FIGS. 10 and 11.

Possible Timing Relationship

In the following, details regarding a possible timing relationship will be described making reference to FIG. 9. FIG. 9 shows a graphical representation of a processing of the different blocks of the original input audio signal 110. A first graphical representation 910 describes a temporal evolution of the original input audio signal 110, wherein an abscissa 912 designates the time. The input audio signal 110 comprises a transient signal portion 920, a length of which may be variable. As a timing reference, processing intervals, or processing blocks 922*a*, 922*b*, 922*c*, of the signal processor 140 are shown in the graphical representation 910. As can be seen, the duration of the transient signal portion 920 may be smaller than the temporal duration of the processing intervals 922*a*, 922*b*, 922*c*. In some cases, however, the temporal duration of the transient signal portion may even be larger than the temporal duration of the processing intervals, or extend across more than only one processing interval. In some cases, the processing intervals 922*a*, 922*b*, 922*c* may also be time-overlapping.

A graphical representation 930 represents the transient-reduced audio signal 132, which can be obtained by the transient replacement performed by the transient signal replacer 130. As can be seen, the transient signal portion 920 has been replaced by a replacement signal portion.

A graphical representation 950 describes the processed audio signal 142, which can be obtained, for example, using a block-wise processing of the transient reduced audio signal 132. The processing may for example be performed using a phase vocoder and a downsampling. In this processing, the blocks may optionally be windowed, the blocks also being optionally overlapping.

A further graphical representation 970 represents the processed audio signal 120 in which the transient (or a modified version thereof) has been re-inserted by the transient signal re-inserter 150.

It is important to note that the transient signal portion 920 would have an impact on the entire block 1" if the transient signal portion 920 had been considered in the block-wise processing, as the transient energy would typically spread out over the whole block in such a block-wise processing. Thus, if the transient signal portion were to be considered in the block-wise processing, the overall energy of the block would possibly for falsified by the transient energy. Further, the transient would be typically spread out (i.e. broaden), if the transient were affected by the block-wise processing. In contrast, the separate processing of the transient allows for the limitation of the impact of the transient to a time interval 1" of the processed audio signal 120, which is associated with the transient. A spreading of the transient signal portion towards a full block of the block-wise signal processing in the signal processor 140 can be avoided. Rather, the duration of the transient signal portion in the processed audio signal 120 can be determined by the transient processing performed by the transient processor 160. Alternatively, it is possible to insert the transient signal portion 920 into the processed audio signal 142 in its original duration, if desired. Thus, an undesired spreading of transient energy in the signal processor 140 can be avoided.

Time Spreading of Audio Signal

As can be seen from the above description, the inventive concept for manipulating an audio signal comprising a transient event can be applied in many different applications. For example, the said concept can be applied in any audio signal processing in which transients would be degraded by the signal processing and in which it is nevertheless desirable to maintain transients. For instance, many types of non-linear audio signal processing would result in seriously degraded results in the presence of transients. Some types of temporal filtering, in addition, would be significantly affected by the presence of transients. Further, any block-wise processing of an audio signal would typically be degraded by the presence of transients, as the energy of the transients would be smeared over a full processing block, thus resulting in audible artifacts.

Nevertheless, time stretching of audio signals can be considered to be a particularly important application of the present concept for manipulating an audio signal comprising a transient event. For this reason, details regarding this application will be described in the following.

In the following, some disadvantages of conventional concepts for the time stretching of audio signals will be described, in order to allow for an understanding of the advantages of the inventive concept. Time stretching of audio signals by a phase vocoder comprises "smearing" transient signal portions by dispersion, since the so-called vertical coherence (in the sense of a specific phase relationship between components of different frequency bands) of the signal is impaired. Methods working with so-called overlap-add (OLA) methods may generate disruptive pre-echoes and retarded echoes of transient sound events. These problems may indeed be met by a more pronounced time stretching in the environment of transients. If a transposition is to take place, however, the transposition factor will no longer be constant in the environment of the transients, i.e. the pitch of superposed (possibly tonal) signal constituents will change and will be perceived as disruptive.

If the transients are cut out and if the resulting gap is stretched, a very large gap will have to be filled following this. If transients follow each other closely, the large gaps might possibly overlap.

In the following, a new method for the transformation of signals will be described. The method presented here solves the problems mentioned above.

According to an aspect of this method, a windowed section containing the transient is interpolated or extrapolated from the signal to be manipulated (e.g. the original input audio signal 110). If the application is time-critical, i.e. if delay is to be avoided, extrapolation may advantageously be chosen. If the future is known as a so-called look-ahead, and if the delay does not play a too important part, interpolation will be advantageous.

In some embodiments, the method may essentially consist of the following steps, and will be illustrated in FIGS. 10 and 11.

1. Recognition of the transient;
2. Determination of the length of the transient;
3. The transient is saved;
4. Extrapolation and/or interpolation;
5. Application of the actual method, e.g. phase vocoder;
6. Re-insertion of the saved transient; and
7. Possibly (optionally) re-sampling (for modification of the sample rate).

When this sequence is performed, the time duration of the transient is shortened at the downsampling. If this is not desired, the transient may be modulated such that is comes to lie within the desired frequency band before it is re-inserted after the shift keying (steps 6 and 7 interchanged).

In the following, some details will be described with reference to FIG. 10. FIG. 10 shows a graphical representation of different signals, which may appear in an embodiment of the apparatus 100 according to FIG. 1. The representation of FIG. 10 is designated in its entirety with 1000. A signal representation 1010 describes a temporal evolution of the original input audio signal 110. As can be seen, the input audio signal 110 comprises a transient signal portion 1012, a variable width (or duration) of which may be determined by the transient detector 130*a* in a signal-adapted manner. The transient signal portion 1012 may be removed by the transient signal replacer 130, and may be replaced by a replacement signal portion. Accordingly, a transient-reduced audio signal 132 can be obtained, which is shown in a signal representation 1020. A replacement signal portion is shown at reference number 1022, replacing the transient signal portion 1012. The transient-reduced audio signal 132 may be processed in a block-wise manner, wherein different processing windows (which determine the granularity of the block-wise processing, and are also designated as "grains") are shown in a signal representation 1030. For example, for each block (or "grain") a set of spectral coefficients may be obtained, so as to form a time-frequency-domain representation of the transient-reduced audio signal 132. A phase-vocoder processing may be applied within the time-frequency-domain representation of the transient-reduced audio signal 132, such that a signal of increased duration is obtained. For this purpose, interpolated time-frequency-domain coefficients may be obtained. The time-frequency-domain coefficients may then be used to construct a time-domain signal, the temporal duration of which is extended when compared to the original input audio signal, while maintaining the pitch. In other words, the number of signal periods is increased. The signal obtained by the phase-vocoder operation is shown in a signal representation 1040. As can be seen from the graphical representation 1040, a so-called "cut out transient area", in which a replacement signal portion has been inserted to replace the transient signal portion, is time shifted with respect to a temporal position of the transient signal portion in the original input audio signal 110 (when considered with reference to a beginning of the input audio signal).

Subsequently, the transient signal portion, which has been previously replaced, is re-inserted, for example by the transient signal re-inserter 150. For example, the transient signal portion described by the transient signal 152 may be cross-faded into the processed version 142 of the transient-reduced audio signal. A result of the transient re-insertion is shown in a graphical representation 1050.

In a subsequent downsampling, a temporal duration of the processed audio signal 120 can be reduced. The downsampling may for example be performed by the signal conditioner 170. The downsampling may for example comprise a change of the time scale. Alternatively, a number of sample points may be reduced. As a consequence, a temporal duration of the downsampled signal is reduced when compared to a signal provided by the phase-vocoder. At the same time, a number of periods may be maintained by the downsampling when compared to the signal provided by the phase-vocoder. Accordingly, the pitch of the downsampled signal, which is shown in a signal representation 1050, may be increased when compared to the signal provided by the phase-vocoder (shown in the signal representation 1040).

FIG. 11 shows another signal representation representing signals appearing in another embodiment of the apparatus 100 of FIG. 1. The processing is similar to the processing explained with reference to FIG. 10, such that the only differences in the order of the processing will be described here, and such that identical signal representations and signal characteristics will be designated with identical reference numerals in FIGS. 10 and 11.

In the signal processing represented in signal representation 1100, the downsampling is performed before the transient signal re-insertion. Thus, a signal representation 1150 shows the downsampled signal without an inserted transient signal portion. However, the transient signal portion is shifted in frequency using a transient frequency shift operation 1160 which may performed by the transient professor 160. The frequency-shifted transient signal (frequency-shifted with respect to the transient signal portion replaced by the transient signal replacer 130) may be re-inserted into the downsampled processed audio signal 142 by the transient signal re-inserter 150. The result of the transient re-insertion is shown in a signal representation 1170.

Fitting of the Transient Signal Portion

In the following, it will be described how the transient signal 152 can be combined with the processed audio signal 142 using the transient signal inserter 150. For example, the transient signal inserter 150 may be configured to cut out a transient area from the processed audio signal 142, into which transient area the transient signal 152 is to be inserted. It can be considered herein that the boundary portions of the transient signal 152 may temporally overlap with the boundary portions of the cut-out transient area. In this overlapping boundary portion a cross fade between the processed audio signal 142 and the transient signal 152 may take place. The transient signal 152 may also be time-shifted with respect to the processed audio signal 142, such that the waveform of the boundary portions of the covered transient area is brought into a good agreement with the waveform of the boundary portions of the transient signal 152.

Accurate fitting may be performed by calculating the maximum of the cross-correlation of the edges of the resulting recess with the edges of the transient portion (wherein the recess may be caused by the cut-out of the transient area from the processed audio signal 142). In this manner, the subjective audio quality of the transient is no longer impaired by dispersion and echo effects.

Precise determination of the position of the transient for the purpose of selecting a suitable cutout may be performed, e.g. using a floating center of gravity calculation of the energy over a suitable period of time.

Optimum fitting of the transient in accordance with the maximum cross correlation may need a slight offset in time over the original position of same. Due to the existence of temporal pre-masking and, in particular, post-masking effects, however, the position of the re-inserted transient need not exactly match the original position. Due to the longer period of action of the post-masking, a shift of the transient in the positive time direction is to be favored in this context. By inserting the original signal portion, a change in the sampling rate leads to a change in the timbre, or the pitch. However, this is generally masked by the transient by means of psychoacoustic masking mechanisms.

Transient Processing

If the transient is to be less tonal prior to the re-insertion than following the cutting out, for example, because it is simply to be added onto the processed signal, the corresponding windowed transient portion will have to be processed in a suitable manner. In this context, inverse (LPC) filtering may be conducted.

An alternative approach will be briefly described in the following:

1. Determining the Short-Time Fourier Transform (STFT) (for example of the transient signal portion described by the transient information 134), to obtain a spectrum;
2. Determining the Cepstrum (e.g. of the spectrum of the transient signal portion);
3. High-pass filtering of the cepstrum (first coefficients are set to 0), to obtain a high-pass filtering of the spectrum;
4. Dividing the spectrum (e.g. of the transient signal portion) by the filtered spectrum (e.g. of the transient signal portion), to obtain a smoothened spectrum; and
5. Inverse transformation (e.g. of the smoothened spectrum) to the time domain (e.g. to obtain the processed transient signal 152).

The resulting signal exhibits (at least approximately) the same spectral envelope as the output signal, but has lost tonal portions.

Method

An embodiment according to the invention comprises a method for manipulating an audio signal comprising a transient event. FIG. 12 shows a flowchart of such a method 1200.

The method 1200 comprises a step 1210 of replacing a transient signal portion, comprising the transient event of the audio signal, with a replacement signal portion adapted to signal energy characteristics of one or more of the non-transient signal portions of the audio signal or to a signal energy characteristic of the transient signal portion, to obtain a transient-reduced audio signal.

The method 1200 further comprises a step 1220 of processing the transient-reduced audio signal, to obtain a processed version of the transient-reduced audio signal.

The method 1200 further comprises a step 1230 of combining the processed version of the transient-reduced audio signal with a transient signal representing, in an original or processed form, a transient content of the transient signal portion.

The method 1200 can be supplemented by any of the features or functionalities described herein with respect also to the above inventive apparatus.

In other words, although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Computer Program

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

Conclusion

To summarize the above, the embodiments according to the present invention comprise a novel method of treating sound events, which are not to be, or cannot be processed by means of the actual processing routine (e.g. using the signal processor). In some embodiments, the inventive method essentially consists of extrapolating or interpolating the signal portion containing the sound events which are to be processed separately. Following the processing, the transient portions treated separately are added again. This processing is not limited to time or frequency stretching, but may generally be employed in signal processing when actual processing of the signal is detrimental to the transient signal portion (or if negatively affected by the transient signal portions).

In the following, some advantages of the novel method are described, which can be obtained in some of the embodiments. With the new method, artifacts (such as dispersion, pre-echo, and retarded echoes) which may arise during processing of the transient using time stretching and transposition methods, are effectively presented. Potential impairment of the quality of superposed (possibly tonal) signal portions is avoided.

Embodiments according to the invention can be applied in different fields of application. The method is, for example, suitable for any audio applications wherein the reproduction speeds of audio signals, or their pitches, are to be changed.

To summarize the above a means and method for a separate treatment of sound events in audio signals in order to avoid artifacts has been described.

Embodiment 2

Another embodiment of the invention will be described in the following taking reference to FIGS. 13-16.

First, details regarding a transient detection will be discussed. Subsequently, the transient handling will be explained with reference to FIGS. 13 and 14. Results of the transient handling will be discussed with reference to FIG. 15. Additional improvements of the transient handling will be explained with reference to FIG. 16. In addition, a performance evaluation of the embodiment will be given, and some conclusions will be made.

Embodiment 2—Transient Detection

To implement the invented concept, it is important to detect the presence of transients in order to allow for a replacement of transients and for a separate handling of transients.

Besides the time stretching application at hand, a wide range of signal processing methods need knowledge about an audio signal's transient content. Prominent examples are block length decisions (B. Edler, "Coding of audio signals with over-lapping block transform and adaptive window functions (in German)," *Frequenz*, vol. 43, no. 9, pp. 252-256, September 1989) or separate encoding of transient signals and stationary (Oliver Niemeyer and Bernd Edler, "Detection and extraction of transients for audio coding," in *AES*120*th Convention*, Paris, France, 2006) in transform audio codecs, modification of transient components (M. M. Goodwin and C. Avendano, "Frequency-domain algorithms for audio signal enhancement based on transient modifiation," *Journal of the Audio Engineering Society*., vol. 54, pp. 827-840, 2006.) and audio signal segmentation (P. Brossier, J. P. Bello, and M. D. Plumbley, "Real-time temporal segmentation of note objects in music signals," in *ICMC*, Miami, USA, 2004). As numerous as its applications are the approaches to detect transients. Most commonly, the detection is performed by computing a detection function (J. P. Bello, L. Daudet, S.

Abdallah, C. Duxbury, M. Davies, and M. B. Sandler, "A tutorial on onset detection in music signals," *Speech and Audio Processing, IEEE Transactions on*, vol. 13, no. 5, pp. 1035-1047, September 2005), i.e. a function with local maxima coinciding with the occurrence of transients. Various proposed methods derive such a detection function by investigating the (weighted) magnitude or energy envelope of sub-band signals, the broad band signal, its derivative or its relative difference function (see, for example, Refs. (A. Klapuri, "Sound onset detection by applying psychoacoustic knowledge," in ICASSP, 1999) and (P. Masri and A. Bateman, "Improved modelling of attack transients in music analysis-resynthesis," in ICMC, 1996).)

Other methods calculate the deviation between the measured and a predicted phase (see, for example, C. Duxbury, M. Davies, and M. Sandler, "Separation of transient information in musical audio using multiresolution analysis techniques," in *DAFX,* 2001), a combined examination of both phase and magnitudes of sub-band signals (see, for example, C. Duxbury, M. Sandler, and M. Davies, "A hybrid approach to musical note onset detection," in *DAFX,* 2002), or the error made by an adaptive linear predictor (see, for example, W-C. Lee and C-C. J. Kuo, "Musical onset detection based on adaptive linear prediction," in *ICME,* 2006). By peak picking, the presence of a transient and its localization in time is derived either as a binary decision, or the continuous detection function is applied to control the behavior of the modification unit (see, for example, Ref. M. M. Goodwin and C. Avendano, "Frequency-domain algorithms for audio signal enhancement based on transient modifiation," *Journal of the Audio Engineering Society., vol.* 54, pp. 827-840, 2006).

With a binary decision, wrong assignments due to misclassifications in the detection stage may cause severe impairments in some applications. For the present algorithm, a false negative (i.e. missing a transient) would be worse than a false positive (i.e. detecting a non-existent transient). The first would lead to a smeared transient component while the latter only yields a superfluous interpolation if the interpolation is carried out properly.

The summarized weighted absolute values of short time Fourier transform blocks are used for the detection of transient areas. This function shows marked rises during attack transients and is also capable of indicating the decay of percussive signals and associated reverb. Peak picking on the smoothed detection function was realized using an adaptive threshold based on a percentile calculation as described, for example, in Ref. J. P. Bello, L. Daudet, S. Abdallah, C. Duxbury, M. Davies, and M. B. Sandler, "A tutorial on onset detection in music signals," *Speech and Audio Processing, IEEE Transactions on*, vol. 13, no. 5, pp. 1035-1047, September 2005.

To summarize the above, different concepts for transient detection are known in the art and can be applied in an invented apparatus. For example, the above described concept for the detection of a transient can be used in the transient detector 130*a* of the transient signal replacer 130.

Embodiment 2—Transient Handling

Figure 13:
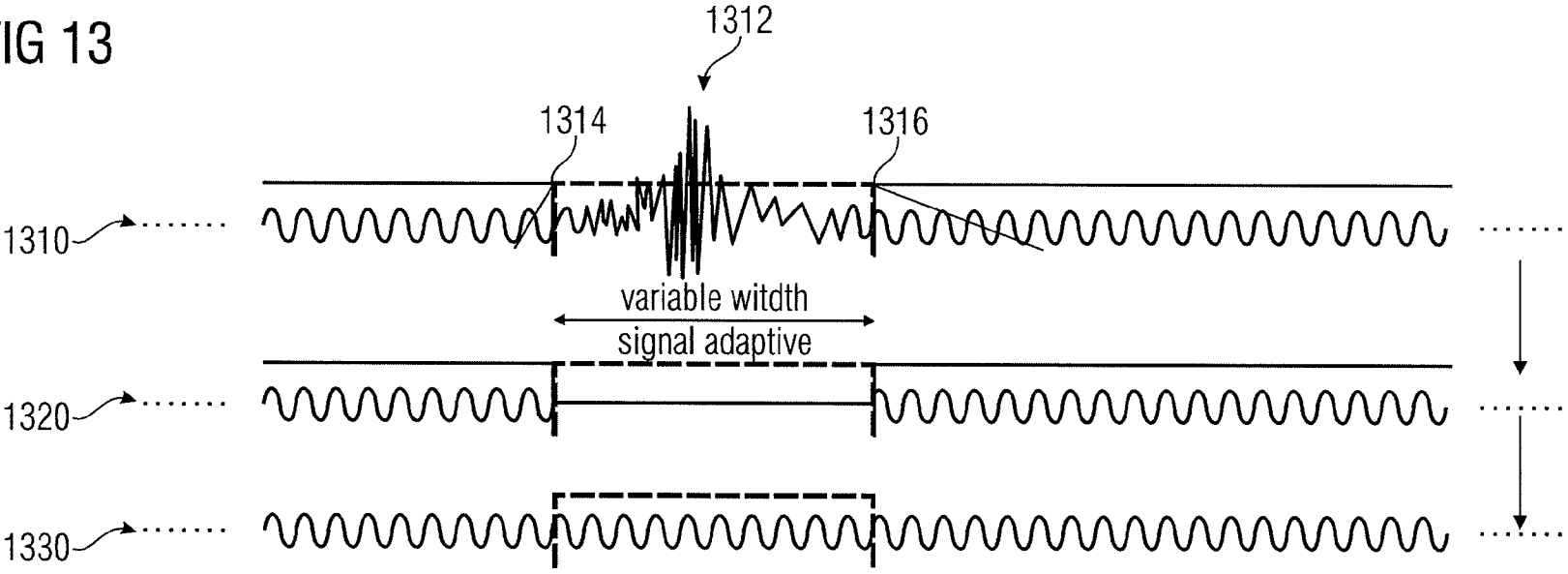
FIG. 13 shows a graphical representation of a transient removal and interpolation, according to an embodiment of the invention.
Figure 14:
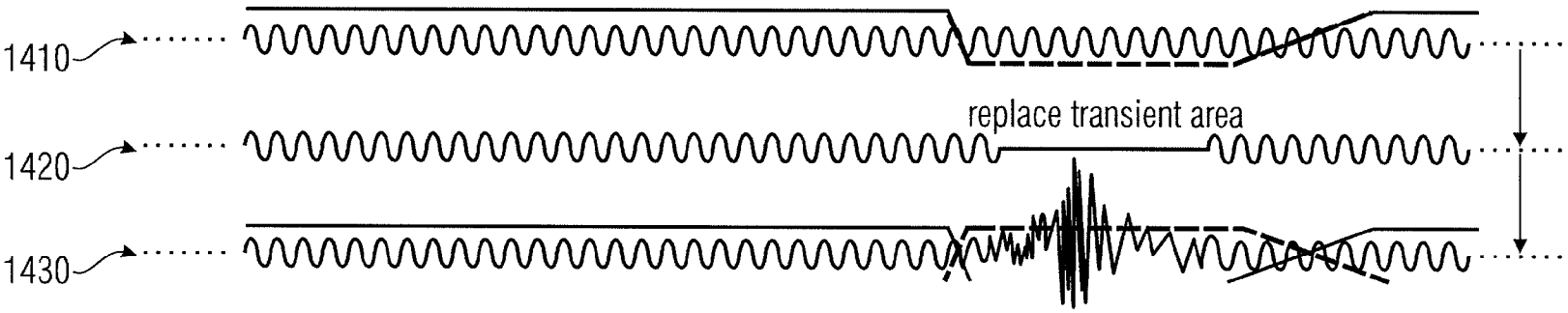
FIG. 14 shows a graphical representation of a time stretching and transient re-insertion, according to an embodiment of the invention.

In the following, the handling of a transient will be described taking reference to FIGS. 13 and 14. FIG. 13 shows a graphical representation of a transient removal and interpolation. FIG. 14 shows a graphical representation of a time stretching and transient reinsertion. Thus, the schematic representations in FIGS. 13 and 14 illustrate the sequence of processing steps of the presented algorithm.

A first row 1310 of FIG. 3 shows the original signal (i.e. the audio signal 110) containing a transient event 1312. In response to (or through) the detection of this transient 1312, a transient area (for example extending from a transient area start position 1314 to a transient area end position 1316) is defined (for example by the transient detector 130*a*) that is subsequently subtracted from the signal. In other words, firstly, the transient is detected and windowed. Secondly, it is subtracted from the signal. A signal, in which the transient is subtracted, is shown in Ref. [B20]. The transient itself is stored for later use. Until this step, the algorithm is identical to that described in Ref. [B8] despite the fact that the cut-out window used here is rectangular (dotted thick line). For storage of the transient, a guard interval of a few milliseconds is preceded and appended and the window is tapered (thin solid line) to define cross-fade areas for a smooth reinsertion of the stored transient into the time deleted transient free signals.

Subsequently, the most important feature of the inventive algorithm according to the present embodiment—the interpolation to pad the gap—is applied. In other words, lastly, the resulting gap is filled through interpolation. A result of the interpolation can be seen in a bottom row of FIG. 13 at Ref. No. 1330. As the signal is typically quasi-stationary after the interpolation, it can now be stretched without introducing annoying artifacts. A result of this stretching is illustrated in a first row of FIG. 14 at Ref. No. 1410. The transient region at the transposed position is identified and prepared for reinsertion of the formerly stored windowed transient. Therefore, the tapered window (which has been applied for extraction and/or storage of the transient, and which is shown by a thin solid line in the graphical representation at Ref. No. 1310) is inverted and applied to the signal in order to allow the transient to be re-added. A result of this process is shown in Ref. No. 1420. Finally, the stored transient is added to the stretched signal, as can be seen in the graphical representation at Ref. No. 1430.

To summarize the above, transient removal and interpolation of the gap, which is caused by the transient removal are shown in FIG. 13. Firstly, the transient is detected and windowed. Secondly, it is subtracted from the signal. Lastly, the resulting gap is filled through the interpolation. FIG. 14 shows the time-stretching and transient reinsertion, which follows the transient removal and interpolation. Firstly, the quasi-stationary signal is stretched, for example, using the vocoder described herein. Subsequently, the position for the transient in the time-stretched signal is prepared by multiplication with the inversed window of that which was used for storing the transient in FIG. 14. Lastly, the transient is re-added to the signal. In other words, finally, the stored transient is added to the stretched signal.

Embodiment 2—Transient Handling Results

Figure 15:
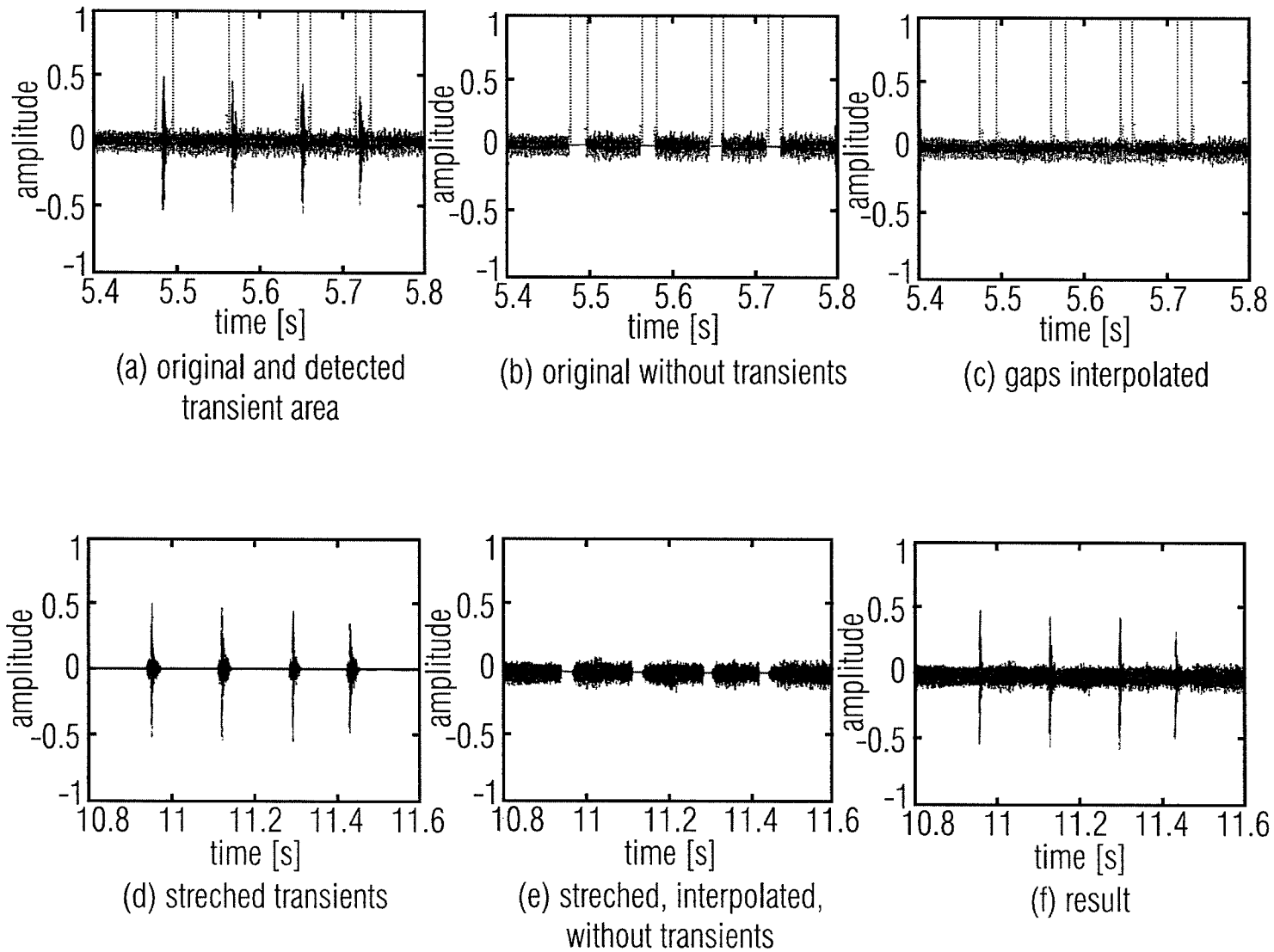
FIG. 15 shows a graphical representation of signal wave forms which occur in different steps of the inventive transient handling in a time stretching application with the phase vocoder.

In the following, some results of the inventive transient handling will be discussed taking reference to FIG. 15. FIG. 15 shows a graphical representation of steps of the inventive transient handling in time-stretching application with the phase vocoder. A first row contains the not-stretched signal, and a second row contains stretched ports. Different time spans used in the graphical representations of the first row and in the second row should be noted.

FIG. 15 demonstrates the results of the different algorithmic steps on the basis of castanets mixed with a pitch pipe.

A waveform plot of the original input signal with an indication of the detected transient areas is depicted in FIG. 15*a*. FIG. 15*b* shows the cutout transient areas that are interpolated (in a subsequent step) to yield in the transient free stationary signal displayed in FIG. 15*c*. FIG. 15*d* contains the transient areas including the cross-fade guard intervals while FIG. 15*e* shows the interpolated (and typically time-stretched) signal that is damped with the inverse cross-fade window at the time deleted transient positions. Completing, FIG. 15*f* displays the final output of the time-stretching algorithm.

Thus, FIG. 15*a* represents the audio signal 110. FIG. 15*e* represents the transient-reduced audio signal 132. FIG. 15*d* represent the transient signal 152. FIG. 15*f* represents the processed audio signal 120.

Embodiment 2—Transient Handling Improvements

Figure 16:
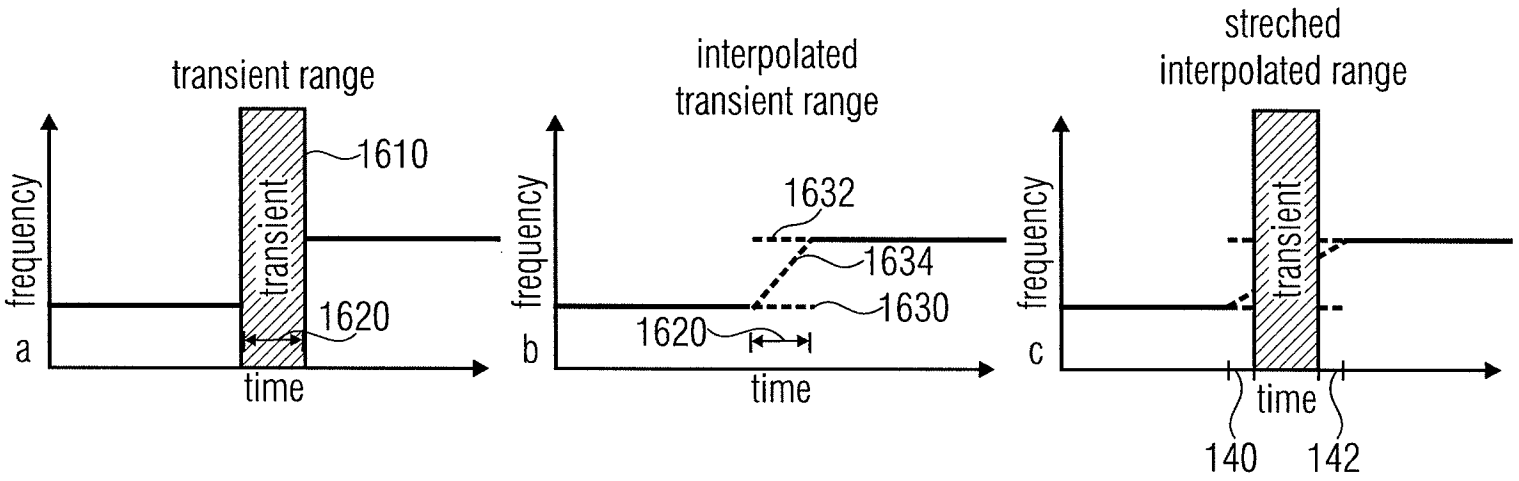
FIG. 16 shows a graphical representation of signals, which are present at the different steps of a time stretching.

It has been found that different concepts regarding the interpolation of the cutout transient areas can be important in some cases. For example, the interpolation over a transient area can be difficult if the signal before the transient considerably differs from the signal after the transient. In that case, the involvement of the signal during the transient event can hardly be predicted in some cases. FIG. 16 illustrates such a situation, simplified by using the possible evaluation of only one respectively two partials by way of example. The algorithm (for example the algorithm for performing the interpolation to pad the gap) has to decide for one involvement of the pitch (of the interpolated signal to fill the gap). The same applies to more complex broadband signals. A possible solution to overcome the problem lies in forward and backward prediction with cross-fade between each other. Thus, such a forward and backward prediction with cross-fade between each other may be applied when computing the interpolated signal to fill the gap.

This problem is illustrated in FIG. 16 and a solution according to an aspect of the invention is presented. FIG. 16 shows that the interpolation of the transient (i.e. interpolation of the gap caused by a removal of the transient) is difficult if the signal changes remarkably during the transient. Infinite ways of pitch contours exist during the interpolation range (i.e. the gap caused by the removal of the transient). FIG. 16*a* shows a graphical representation of a signal containing a transient event in form of a time-frequency representation. A transient range, i.e. a time interval which has been identified as a transient time interval, is designated with 1610. FIG. 16*b* shows a graphical representation of different possibilities for obtaining a temporal portion of the input audio signal during which a transient has been detected and removed. As can be seen, if there is a first pitch temporally preceding the time interval 1620 during which the transient is removed from the input audio signal, and a second pitch temporally after the time interval 1620, it is needed to determine a pitch evolution for filling the gap which is left by removing the transient time interval 1620. As can be seen, it is, for example, possible to forward-extrapolate (in time direction) the pitch preceding the time interval 1620, to obtain the pitch during the time interval 1620 (see the dashed line 1630). Alternatively, it is possible to backward-extrapolate (in temporal direction) a pitch, which is present after the time interval 1620, to the time interval 1620 (seethe dashed line 1632). Alternatively, it is possible to interpolate, during the time interval 1620, between a pitch which is present before the time interval 1620 and a pitch which is present after the time interval 1620 (see dashed line 1634). Naturally, different schemes of obtaining a pitch evolution during the time interval 1620 (gap caused by transient removal) are possible.

An impact of the finally obtained processed audio signal, after transient signal reinsertion, is shown in FIG. 16*c*. As can be seen, the reinserted transient signal portion (which reflects an original or processed transient content of the transient signal portion) may be temporally shorter than the processed (for example time-stretched) audio signal 142, which has been processed without the transient content. Thus, the choice of the concept for filling the gap caused by the transient removal in the audio signal 132 may actually have an audible impact on the processed audio signal 120 even after transient reinsertion, for example if the reinserted transient portion (described by the transient signal 152) is shorter than the processed result of the gap-filling in the processed audio signal 142. Reference is made to time interval 140 preceding the reinserted transient and a time interval 142 following the reinserted transient.

To summarize the above, it has been shown with reference to FIG. 16 that the interpolation of the transient area needs some consideration if the signal changes remarkable during the transient. Infinite ways of pitch contours exist during the interpolation range. FIG. 16*a* shows a signal containing a transient event. FIG. 16*b* shows different possibilities for interpolations of the transient range, which are indicated by dotted lines. FIG. 16*c* shows a stretched signal. As the stretched interpolated regions extend beyond the transient parts, the interpolated signal is audible and can lead to perceptual artifacts.

Embodiment 2—Performance Evaluation

To gain some insight to the perceptual performance of the proposed method, informal listening was conducted. The selected signals included items with both transient and stationary signal characteristics in order to evaluate the benefit of the new scheme for transient signals while, at the same time, insuring that stationary signals are not degraded.

This informal test revealed a significant benefit for the aforementioned combination of pitch pipe and castanets in comparison with state of the art software time-stretching algorithm. The result showed a preference on PV based time-stretching algorithms over WSOLA when the focus is lead on transient signals.

Real-world signals stretched with the new method were also sometimes advantageous over the other methods.

Conclusion

To summarize the above, a novel transient handling scheme has been described, which can be advantageously used for time-stretching algorithms. Changing either speed or pitch of audio signals without affecting the respective other is often used for music production and creative reproduction, such as remixing. It is also utilized for other purposes such as bandwidth extension and speed enhancement. While stationary signals can be stretched without harming the quality, transients are often not well maintained after stretching when using conventional algorithms. The present invention demonstrates an approach for transient handling in time-stretching algorithms. Transient regions are replaced by stationary signals. The thereby removed transients are saved and reinserted to the time-dilated stationary audio signal after time-stretching.

A challenge is issued by the task to stretch a combination of a very tonal signal such as a pitch pipe and a percussive signal such as castanets.

While some conventional methods approximately preserve the envelope of a signal in the time-stretched version as well as its spectral characteristics, and expect a time dilated percussive event to decay slower than the original, the present invention follows the opposite assumption that for time-scaling of musical signals, the goal is to preserve the envelope of transient events. Therefore, some embodiments according to the invention only stretch the sustained component to achieve an effect which sounds like the same instrument played at a different temper (see, for example, Ref. [B3]). To achieve this, transient and stationary signal components are treated separately according to the invention.

Embodiments according to the invention are based on a concept which has been described in publication [B8], in which it has been demonstrated how transients can be preserved in time and frequency stretching with the phase vocoder. In that approach, transients are cut out from the signal before it is stretched. The removal of the transient part results in gaps within the signal which are stretched by the phase vocoder process. After the stretching, the transients are re-added to the signal with a surrounding that fits the stretched gaps. However, it has been found that the solution comprises some advantages for many signals. However, it has also been found that by cutting out the transients, new artifacts arrive, as the gaps introduce new non-stationary parts to the signal, in particular at the boundaries of the introduced gaps. Such non-stationarities can be seen, for example, in FIG. 15*b*.

Embodiments of the inventive method described herein have the advantage over the techniques described, for example, in publications [B3], [B6], [B7] that they enable time-stretching without a necessity to change the stretching factor in the surrounding of a transient. The inventive method has commonalities with the methods described, for example, in references [B8] and [B5]. The inventive scheme divides the signal into a transient part and a transient-free quasi stationary signal. In contrast to the method described in [B8], the gaps, which arise from cutting out the transients, are replaced by stationary signals. An interpolation method is utilized to estimate a continuation of the signals surrounding the gap-period throughout the gap. The resulting quasi-stationary part is then well suited for time-stretching algorithms. Due to the fact that this signal does now (i.e. after the interpolation or extrapolation) include neither transients nor gaps anymore, artifacts of both stretched transients and stretched gaps can be prevented. After execution of the stretching, the transients replace parts of the interpolated signal. The technique relies on both, the correct detection of transients and a perceptually correct interpolation of the stationary part. However, apart from interpolation, other filling techniques can be used as described above.

To better summarize the above, in some embodiments described above, the aim was to stretch a combination of a strictly tonal and a transient signal, such as pitch pipe plus castanets, without any perceptual artifacts. It has been shown that the present invention provides a significant advance on a way towards this aim. One of the important aspects of the present invention lies in the correct identification on a transient event, especially its exact onset, and more difficult, its decay and its associated reverb. Since decay and a reverb of a transient event are overlaid with the stationary parts of the signal, these portions need a meticulous handling in order to avoid perceptual fluctuations after re-adding to the stretched parts of the signal.

Some listeners tend to take versions in which the reverb is stretched together with the sustained signal parts. This preference contradicts the actual aim to consider a transient and associated sounds as an entity. Therefore, in some cases, more insight into listeners' preference is needed.

However, the idea and the principle approach, according to the present invention, have proven their value and application for a special case. Nevertheless, it is expected that the range of applications of the present invention can even be extended. Due to its structure, the inventive algorithm can easily be adapted to be used for a manipulation of the transient part, e.g. changing their level compared to the stationary signal parts.

A further possible application of the inventive method would be to arbitrarily attenuate or gain transients for replay. This could be exploited for changing the loudness of transient events such as drums or even to entirely remove them, as a separation of the signal into transient and stationary part is inherent to the algorithm.

The above described embodiments are merely illustrative for the principles of the present invention. It is understood that modifications and variations of the arrangements and the details described herein will be apparent to others skilled in the art. It is the intent, therefore, to be limited only by the scope of the independent patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[A1] J. L. Flanagan and R. M. Golden, "The Bell System Technical Journal, November 1966", pages 1394 to 1509;

[A2] U.S. Pat. No. 6,549,884, Laroche, J. & Dolson, M.: "Phase—vocoder pitch-shifting";

[A3] Jean Laroche and Mark Dolson, "New Phase-Vocoder Techniques for Pitch-Shifting, Harmonizing and Other Exotic Effects", by Proc.

[A4] Zölzer, U: "DAFX: Digital Audio Effects", Wiley & Sons, Edition: 1 (26 Feb. 2002), pages 201-298;

[A5] Laroche L., Dolson M.: "Improved phase vocoder timescale modification of audio", IEEE Trans. Speech and Audio Processing, vol. 7, no. 3, pp. 323-332;

[A6] Emmanuel Ravelli, Mark Sandler and Juan P. Bello: "Fast implementation for non-linear time-scaling of stereo audio", Proc. of the 8$^{th}$ Int. Conference on Digital Audio Effects (DAFx'05), Madrid, Spain, Sep. 20-22, 2005;

[A7] Duxbury, C., M. Davies, and M. Sandler (2001, December): "Separation of transient information in musical audio using multiresolution analysis techniques". In: Proceedings of the COST G-6 Conference on Digital Audio Effects (DAFX-01), Limerick, Ireland;

[A8] Röbel A.: "A NEW APPROACH TO TRANSIENT PROCESSING IN THE PHASE VOCODER", Proc. Of the 6$^{th}$ Int. Conference on Digital Audio Effects (DAFx-03), London, UK, Sep. 8-11, 2003.

[B1] T. Karrer, E. Lee, and J. Borchers, "Phavorit: A phase vocoder for real-time interactive time-stretching," in *Proceedings of the ICMC* 2006 *International Computer Music Conference*, New Orleans, USA, November 2006, pp. 708-715.

[B2] T. F. Quatieri, R. B. Dunn, R. J. McAulay, and T. E. Hanna, "Time-scale modifications of complex acoustic signals in noise," Technical report, Massachusetts Institute of Technology, February 1994.

[B3] C. Duxbury, M. Davies, and M. B. Sandler, "Improved time-scaling of musical audio using phase locking at transients," in 112*th AES Convention*, Munich, 2002, Audio Engineering Society.

[B4] S. Levine and Julius O. Smith III, "A sines+transients+noise audio representation for data compression and time/pitchscale modifications," 1998.

[B5] T. S. Verma and T. H. Y. Meng, "Time scale modification using a sines+transients+noise signal model," in *DAFX*98, Barcelona, Spain, 1998.

[B6] A. Röbel, "A new approach to transient processing in the phase vocoder," in 6*th Conference on Digital Audio Effects* (*DAFx*-03), London, 2003, pp. 344-349.

[B7] A. Röbel, "Transient detection and preservation in the phase vocoder," in *Int. Computer Music Conference* (ICMC 03), Singapore, 2003, pp. 247-250.

[B8] F. Nagel, S. Disch, and N. Rettelbach, "A phase vocoder driven bandwidth extension method with novel transient handling for audio codecs," in 126*th AES Convention*, Munich, 2009.

[B9] M. Dotson, "The phase vocoder: A tutorial," *Computer Music Journal*, vol. 10, no. 4, pp. 14-27, 1986.

[B10] B. Edler, "Coding of audio signals with over-lapping block transform and adaptive window functions (in german)," *Frequenz*, vol. 43, no. 9, pp. 252-256, September 1989.

[B11] Oliver Niemeyer and Bernd Edler, "Detection and extraction of transients for audio coding," in *AES* 120*th Convention*, Paris, France, 2006.

[B12] M. M. Goodwin and C. Avendano, "Frequency-domain algorithms for audio signal enhancement based on transient modifiation," *Journal of the Audio Engineering Society*., vol. 54, pp. 827-840, 2006.

[B13] P. Brossier, J. P. Bello, and M. D. Plumbley, "Real-time temporal segmentation of note objects in music signals," in *ICMC*, Miami, USA, 2004.

[B14] J. P. Bello, L. Daudet, S. Abdallah, C. Duxbury, M. Davies, and M. B. Sandler, "A tutorial on onset detection in music signals," *Speech and Audio Processing, IEEE Transactions on*, vol. 13, no. 5, pp. 1035-1047, September 2005.

[B15] A. Klapuri, "Sound onset detection by applying psychoacoustic knowledge," in ICASSP, 1999.

[B16] P. Masri and A. Bateman, "Improved modelling of attack transients in music analysis-resynthesis," in ICMC, 1996.

[B17] C. Duxbury, M. Davies, and M. Sandler, "Separation of transient information in musical audio using multiresolution analysis techniques," in *DAFX,* 2001.

[B18] C. Duxbury, M. Sandler, and M. Davies, "A hybrid approach to musical note onset detection," "in *DAFX,* 2002.

[B19] W-C. Lee and C-C. J. Kuo, "Musical onset detection based on adaptive linear prediction," in *ICME,* 2006.

[Edler] O. Niemeyer and B. Edler, "Detection and extraction of transients for audio coding", presented at the AES 120$^{th}$ Convention, Paris, France, 2006;

[Bello] J. P. Bello et al., "A Tutorial on Onset Detection in Music Signals", IEEE Transactions on Speech and Audio Processing, Vol. 13, No. 5, September 2005;

[Goodwin] M. Goodwin, C. Avendano, "Enhancement of Audio Signals Using Transient Detection and Modification", presented at the AES 117$^{th}$ Convention, USA, October 2004;

[Walther] Walther et al., "Using Transient Suppression in Blind Multi-channel Upmix Algorithms", presented at the AES 122th Convention, Austria, May 2007;

[Maher] R. C. Maher, "A Method for Extrapolation of Missing Digital Audio Data", JAES, Vol. 42, No. 5, May 1994;

[Daudet] L. Daudet, "A review on techniques for the extraction of transients in musical signals", book series: Lecture Notes in Computer Science, Springer Berlin/Heidelberg, Volume 3902/2006, Book: Computer Music Modeling and Retrieval, pp. 219-232.

The invention claimed is:

1. An apparatus for manipulating an audio signal comprising a transient event, the apparatus comprising:

a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal;

a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion, to obtain a processed signal;

wherein the transient signal replacer is configured to extrapolate amplitude values of one or more signal portions preceding the transient signal portion, to acquire amplitude values of the replacement signal portion, and wherein the transient signal replacer is configured to extrapolate phase values of one or more signal portions preceding the transient signal portion to acquire phase values of the replacement signal portion.

2. The apparatus according to claim 1, wherein the transient signal replacer is configured to provide the replacement signal portion such that the replacement signal portion represents a time signal comprising a smoothened temporal evolution when compared to the transient signal portion, such that a deviation between an energy of the replacement signal portion and an energy of a non-transient signal portion of the audio signal preceding the transient signal portion or following the transient signal portion is smaller than a predetermined threshold value.

3. The apparatus according to claim 1, wherein the transient signal replacer is configured to apply a weighted noise to acquire the amplitude values of the replacement signal portion, or to apply a weighted noise to acquire the phase values of the replacement signal portions.

4. The apparatus according to claim 1, wherein the transient signal replacer is configured to combine non-transient components of the transient signal portion with the extrapolated or interpolated values, to acquire the replacement signal portion.

5. The apparatus according to claim 1, wherein the transient signal replacer is configured to acquire replacement signal portions of variable length in dependence on a length of the present transient signal portion.

6. The apparatus according to claim 1, wherein the signal processor is configured to process the transient-reduced audio signal such that a given temporal signal portion of the processed version of the transient-reduced audio signal is dependent on a plurality of temporally shifted temporal signal portions of the transient-reduced audio signal.

7. The apparatus according to claim 1, wherein the signal processor is configured to perform a time-block-based processing of the transient-reduced audio signal, to acquire the processed version of the transient-reduced audio signal; and wherein the transient signal replacer is configured to adjust the duration of the transient signal portion to be replaced by the replacement signal portion with a temporal resolution which is finer than the duration of a time block, or to replace a transient signal portion comprising a temporal duration smaller than the duration of the time block with a replacement signal portion comprising a temporal duration smaller than the duration of the time block.

8. The apparatus according to claim 1, wherein the signal processor is configured to process the transient-reduced audio signal in a frequency-dependent way, so that the processing introduces transient-degrading frequency-dependent phase shifts into the transient-reduced audio signal.

9. The apparatus according to claim 1, wherein the transient signal replacer comprises a transient detector, wherein the transient detector is configured to provide a time-varying detection threshold for the detection of the transient in the audio signal such that the detection threshold follows an envelope of the audio signal with on adjustable smoothing time constant, and wherein the transient detector is configured to change the smoothing time constant in response to the detection of a transient and/or in dependence on a temporal evolution of the audio signal.

10. The apparatus according to claim 1, wherein the apparatus comprises a transient processor configured to receive a transient information and to acquire, on the basis of the transient information, a processed transient signal in which tonal components are reduced, and wherein the transient signal re-inserter is configured to combine the processed version of the transient-reduced audio signal with the processed transient signal provided by the transient processor.

11. The apparatus according to claim 1, wherein the transient signal replacer comprises a transient detector configured to detect a transient signal portion of the audio signal on the basis of a monitoring of the audio signal, or on the basis of a side information accompanying the audio signal, and to determine a length of the transient signal portion;

wherein the transient signal replacer is configured to take into account the length of the transient signal portion determined by the transient detector;

wherein the transient signal replacer is configured to extrapolate, in a time-frequency domain, complex-valued time-frequency-domain coefficients associated with a non-transient signal portion of the audio signal preceding the transient signal portion, to acquire time-frequency domain coefficients of the replacement signal portion, or wherein the transient signal replacer is configured to interpolate, in a time-frequency domain, between complex-valued time-frequency-domain coefficients associated with a non-transient signal portion of the audio signal preceding the transient signal portion, and complex-valued time-frequency domain coefficients associated with a non-transient signal portion of the audio signal following the transient signal portion, to acquire time-frequency domain coefficients of the replacement signal portion;

wherein the signal processor is configured to perform a transient-degrading audio signal processing by time stretching or time compression, such that the processed signal provided by the signal processor comprises a duration greater than, or smaller than, a duration of the unprocessed signal received by the audio signal processor; and wherein the apparatus is configured to adapt a time-scaling or sample rate of the signal acquired by the transient signal re-inserter such that at least non-transient components of the signal acquired by the transient signal re-inserter are frequency-transposed when compared to the audio signal input into the transient signal replacer.

12. The apparatus according to claim 1, wherein the a transient signal re-inserter is configured to cross-fade the processed version of the transient-reduced audio signal with a transient signal representing, in an original or processed form, a transient content of the transient signal portion.

13. The apparatus according to claim 1, wherein the apparatus is configured to obtain the processed signal such that the processed signal comprises an unprocessed transient, or wherein the apparatus comprises a transient processor which is configured to derive the transient signal from a transient information using a transient frequency transposition, or using a transient frequency shift, or using a transient synthesis.

14. The apparatus according to claim 1, wherein the transient signal represents, in an original or processed form, a transient content of the transient signal portion which has been replaced with the replacement signal portion by the transient signal replacer.

15. An apparatus for manipulating an audio signal comprising a transient event, the apparatus comprising:

a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal;

a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion, to obtain a processed signal;

wherein the transient signal replacer is configured to interpolate between an amplitude value of a signal portion preceding the transient signal portion and an amplitude value of a signal portion following the transient signal portion, to acquire one or more amplitude values of the replacement signal portion, and wherein the transient signal replacer is configured to interpolate between a phase value of a signal portion preceding the transient signal portion and a phase value of a signal portion following the transient signal portion, to acquire one or more phase values of the replacement signal portion.

16. An apparatus for manipulating an audio signal comprising a transient event, the apparatus comprising:

a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal;

a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion, to obtain a processed signal;

wherein the transient signal replacer is configured to extrapolate, in a time-frequency domain, complex-valued time-frequency-domain coefficients associated with a non-transient signal portion of the audio signal preceding the transient signal portion, to acquire time-frequency domain coefficients of the replacement signal portion, or wherein the transient signal replacer is configured to interpolate, in a time-frequency domain, between complex-valued time-frequency-domain coefficients associated with a non-transient signal portion of the audio signal preceding the transient signal portion, and complex-valued time-frequency domain coefficients associated with a non-transient signal portion of the audio signal following the transient signal portion, to acquire time-frequency domain coefficients of the replacement signal portion.

17. A method for manipulating an audio signal comprising a transient event, the method comprising:

replacing a transient signal portion, comprising the transient event, of the audio signal with a replacement signal portion adapted to signal energy characteristics of one or more non-transient signal portions of the audio signal, or to signal energy characteristics of the transient signal portion, to acquire a transient-reduced audio signal;

processing the transient-reduced audio signal, to acquire a processed version of the transient-reduced audio signal; and combining the processed version of the transient-reduced audio signal with a transient signal representing, in an original or processed form, a transient content of the transient signal portion;

wherein amplitude values of one or more signal portions preceding the transient signal portion are extrapolated to acquire amplitude values of the replacement signal portion, and wherein phase values of one or more signal portions preceding the transient signal portion are extrapolated to acquire phase values of the replacement signal portion; or wherein an interpolation is performed between an amplitude value of a signal portion preceding the transient signal portion and an amplitude value of a signal portion following the transient signal portion, to acquire one or more amplitude values of the replacement signal portion, and wherein an interpolation is performed between a phase value of a signal portion preceding the transient signal portion and a phase value of a signal portion following one or more phase values of the replacement signal portion; or wherein complex-valued time-frequency-domain coefficients associated with a non-transient signal portion of the audio signal preceding the transient signal portion are extrapolated in a time-frequency-domain, to acquire time-frequency-domain coefficients of the replacement signal portion; or wherein an interpolation is performed, in a time-frequency-domain, between complex-valued time-frequency-domain coefficients associated with a non-transient signal portion of the audio signal preceding the transient signal portion, and complex-valued time-frequency-domain coefficients associated with a non-transient signal portion of the audio signal following the transient signal portion, to acquire time-frequency-domain coefficients of the replacement signal portion.

18. A non-transitory computer-readable medium having instructions stored thereon, wherein the instructions, when executed by a computer, perform the method for manipulating an audio signal comprising a transient event, the method comprising:

replacing a transient signal portion, comprising the transient event, of the audio signal with a replacement signal portion adapted to signal energy characteristics of one or more non-transient signal portions of the audio signal, or to signal energy characteristics of the transient signal portion, to acquire a transient-reduced audio signal;

processing the transient-reduced audio signal, to acquire a processed version of the transient-reduced audio signal; and combining the processed version of the transient-reduced audio signal with a transient signal representing, in an original or processed form, a transient content of the transient signal portion;

wherein amplitude values of one or more signal portions preceding the transient signal portion are extrapolated to acquire amplitude values of the replacement signal portion, and wherein phase values of one or more signal portions preceding the transient signal portion are extrapolated to acquire phase values of the replacement signal portion; or wherein an interpolation is performed between an amplitude value of a signal portion preceding the transient signal portion and an amplitude value of a signal portion following the transient signal portion, to acquire one or more amplitude values of the replacement signal portion, and wherein an interpolation is performed between a phase value of a signal portion preceding the transient signal portion and a phase value of a signal portion following one or more phase values of the replacement signal portion; or wherein complex-valued time-frequency-domain coefficients associated with a non-transient signal portion of the audio signal preceding the transient signal portion are extrapolated in a time-frequency-domain, to acquire time-frequency-domain coefficients of the replacement signal portion; or wherein an interpolation is performed, in a time-frequency-domain, between complex-valued time-frequency-domain coefficients associated with a non-transient signal portion of the audio signal preceding the transient signal portion, and complex-valued time-frequency-domain coefficients associated with a non-transient signal portion of the audio signal following the transient signal portion, to acquire time-frequency-domain coefficients of the replacement signal portion.

19. An apparatus for manipulating an audio signal comprising a transient event, the apparatus comprising:

a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal;

a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion;

wherein the transient signal replacer is configured to extrapolate amplitude values of one or more signal portions preceding the transient signal portion, to acquire amplitude values of the replacement signal portion, and wherein the transient signal replacer is configured to extrapolate phase values of one or more signal portions preceding the transient signal portion to acquire phase values of the replacement signal portion;

wherein the transient signal replacer comprises a transient detector configured to detect a transient signal portion of the audio signal on the basis of a monitoring of the audio signal, or on the basis of a side information accompanying the audio signal, and to determine a length of the transient signal portion;

wherein the transient signal replacer is configured to take into account the length of the transient signal portion determined by the transient detector.

20. An apparatus for manipulating an audio signal comprising a transient event, the apparatus comprising:

a transient signal replacer configured to replace a transient signal portion, comprising the transient event, of the audio signal with a replacement signal portion adapted to signal energy characteristics of one or more non-transient signal portions of the audio signal, or to a signal energy characteristic of the transient signal portion, to acquire a transient-reduced audio signal;

a signal processor configured to process the transient-reduced audio signal, to acquire a processed version of the transient-reduced audio signal; and a transient signal re-inserter configured to combine the processed version of the transient-reduced audio signal with a transient signal representing, in an original or processed form, a transient content of the transient signal portion;

wherein the transient signal replacer is configured to extrapolate amplitude values of one or more signal portions preceding the transient signal portion, to acquire amplitude values of the replacement signal portion, and wherein the transient signal replacer is configured to extrapolate phase values of one or more signal portions preceding the transient signal portion to acquire phase values of the replacement signal portion;

wherein the signal processor is configured to perform a transient-degrading audio signal processing by time stretching or time compression, such that the processed signal provided by the signal processor comprises a duration greater than, or smaller than, a duration of the unprocessed signal received by the audio signal processor; and wherein the apparatus is configured to adapt a time-scaling or sample rate of the signal acquired by the transient signal re-inserter such that at least non-transient components of the signal acquired by the transient signal re-inserter are frequency-transposed when compared to the audio signal input into the transient signal replacer.

* * * * *